US010407802B2

(12) United States Patent
Jackson et al.

(10) Patent No.: US 10,407,802 B2
(45) Date of Patent: Sep. 10, 2019

(54) METHOD OF PRODUCING CARBON FIBERS FROM MULTIPURPOSE COMMERCIAL FIBERS

(71) Applicant: UT-Battelle, LLC, Oak Ridge, TN (US)

(72) Inventors: Connie D. Jackson, Harriman, TN (US); Amit K. Naskar, Knoxville, TN (US)

(73) Assignee: UT-Battelle LLC, Oak Ridge, TN (US)

( * ) Notice: Subject to any disclaimer, the term of this patent is extended or adjusted under 35 U.S.C. 154(b) by 146 days.

(21) Appl. No.: 15/395,926

(22) Filed: Dec. 30, 2016

(65) Prior Publication Data

US 2017/0191194 A1 Jul. 6, 2017

Related U.S. Application Data

(60) Provisional application No. 62/305,232, filed on Mar. 8, 2016, provisional application No. 62/273,559, filed on Dec. 31, 2015.

(51) Int. Cl.
*D01F 9/22* (2006.01)

(52) U.S. Cl.
CPC ..... *D01F 9/225* (2013.01)

(58) Field of Classification Search
CPC .... D01F 9/225; C01B 31/022; C01B 31/0226
See application file for complete search history.

(56) References Cited

U.S. PATENT DOCUMENTS 2,913,802 A 11/1959 Barnett et al.
3,296,341 A 1/1967 Briar et al.
(Continued)

FOREIGN PATENT DOCUMENTS

CA 952668 A 8/1974
CN 101560701 A 10/2009
(Continued)

OTHER PUBLICATIONS

Liu, Yaodong, Han Gi Chae, and Satish Kumar. "Gel-spun carbon nanotubes/polyacrylonitrile composite fibers. Part III: Effect of stabilization conditions on carbon fiber properties." Carbon 49.13 (2011): 4487-4496.*

(Continued)

*Primary Examiner* — Richard M Rump
(74) *Attorney, Agent, or Firm* — Fox Rothschild LLP

(57) ABSTRACT

A method of producing carbon fibers includes the step of providing polyacrylonitrile precursor polymer fiber filaments. The polyacrylonitrile precursor filaments include from 87-97 mole % acrylonitrile, and less than 0.5 mole % of accelerant functional groups. The filaments are no more than 3 deniers per filament. The polyacrylonitrile precursor fiber filaments can be arranged into tows of at least 150,000 deniers per inch width. The arranged polyacrylonitrile precursor fiber tows are stabilized by heating the tows in at least one oxidation zone containing oxygen gas and maintained at a first temperature $T_1$ while stretching the tows at least 10% to yield a stabilized precursor fiber tow. The stabilized precursor fiber tows are carbonized by passing the stabilized precursor fiber tows through a carbonization zone. Carbon fibers produced by the process are also disclosed.

50 Claims, 12 Drawing Sheets

(56) References Cited

U.S. PATENT DOCUMENTS

| | | | |
|---|---|---|---|
| 3,412,062 | A | 11/1968 | Johnson et al. |
| 3,466,716 | A | 9/1969 | Hancock et al. |
| 3,533,743 | A | 10/1970 | Prescott et al. |
| 3,539,295 | A | 11/1970 | Ram et al. |
| 3,607,059 | A | 9/1971 | Joo et al. |
| 3,607,817 | A | 9/1971 | Trapasso et al. |
| 3,716,331 | A | 2/1973 | Schalamon et al. |
| 3,914,394 | A | 10/1975 | Fukushima et al. |
| 3,917,776 | A | 11/1975 | Saito et al. |
| 3,945,093 | A | 3/1976 | Larsen et al. |
| 3,965,227 | A | 6/1976 | Stoy et al. |
| 4,001,382 | A | 1/1977 | Matsumura et al. |
| 4,002,426 | A | 1/1977 | Chenevey et al. |
| 4,051,659 | A | 10/1977 | Blakelock |
| 4,069,297 | A | 1/1978 | Saito et al. |
| 4,100,004 | A | 7/1978 | Moss et al. |
| 4,113,847 | A | 9/1978 | Fukushima et al. |
| 4,154,807 | A | 5/1979 | Kishimoto et al. |
| 4,336,022 | A | 6/1982 | Lynch et al. |
| 4,397,831 | A | 8/1983 | Saito et al. |
| 4,526,770 | A | 7/1985 | Pepper et al. |
| 4,535,027 | A | 8/1985 | Kobashi et al. |
| 4,610,860 | A | 9/1986 | Mullen |
| 4,661,336 | A | 4/1987 | McCabe |
| 4,698,413 | A | 10/1987 | Lynch et al. |
| 4,726,770 | A | 2/1988 | Kurer |
| 4,728,395 | A | 3/1988 | Boyd, Jr. |
| 4,780,301 | A | 10/1988 | Nakatani et al. |
| 4,850,186 | A | 7/1989 | Hiramatsu et al. |
| 4,874,563 | A | 10/1989 | McMahon et al. |
| 4,917,836 | A | 4/1990 | Yamane et al. |
| 4,933,128 | A | 6/1990 | Daumit et al. |
| 4,935,180 | A | 6/1990 | Daumit et al. |
| 5,004,590 | A | 4/1991 | Schimpf |
| 5,051,216 | A | 9/1991 | Nakatani et al. |
| 5,066,433 | A | 11/1991 | Paul, Jr. |
| 5,078,926 | A | 1/1992 | McHenry et al. |
| 5,256,344 | A | 10/1993 | Schimpf |
| 5,268,158 | A | 12/1993 | Paul, Jr. |
| 5,503,929 | A | 4/1996 | McCullough, Jr. et al. |
| 5,804,108 | A | 9/1998 | Wilkinson |
| 6,054,214 | A | 4/2000 | Wilkinson |
| 6,210,622 | B1 | 4/2001 | Reese et al. |
| 6,245,423 | B1 | 6/2001 | Ikeda et al. |
| 6,268,450 | B1 | 7/2001 | Wade |
| 6,276,624 | B1 | 8/2001 | Endo et al. |
| 6,294,252 | B1 | 9/2001 | Yamanaka et al. |
| 6,428,891 | B1 | 8/2002 | Okuya et al. |
| 6,635,199 | B2 | 10/2003 | Yamanaka et al. |
| 6,641,915 | B1 | 11/2003 | Kasabo et al. |
| 7,223,376 | B2 | 5/2007 | Panter et al. |
| 7,749,479 | B2 | 7/2010 | Leon y Leon |
| 7,942,359 | B2 | 5/2011 | Kiriyama et al. |
| 8,137,810 | B2 | 3/2012 | Ise et al. |
| 8,591,859 | B2 | 11/2013 | Leon y Leon |
| 8,734,754 | B2 | 5/2014 | Leon y Leon |
| 8,801,985 | B2 | 8/2014 | Ikeda et al. |
| 9,121,112 | B2 | 9/2015 | Leon y Leon |
| 2007/0196648 | A1 | 8/2007 | Endo et al. |
| 2012/0077032 | A1 | 3/2012 | Chasiotis et al. |
| 2013/0130028 | A1 | 5/2013 | Choi et al. |
| 2013/0295811 | A1 | 11/2013 | Shinmen et al. |
| 2014/0212663 | A1 | 7/2014 | Shinmen et al. |
| 2014/0228519 | A1 | 8/2014 | Nakayama et al. |
| 2015/0094401 | A1 | 4/2015 | Kiriyama et al. |
| 2015/0114262 | A1 | 4/2015 | Kiriyama et al. |
| 2015/0315727 | A1 | 11/2015 | Leon y Leon |
| 2016/0060793 | A1 | 3/2016 | Sugiura et al. |
| 2016/0244893 | A1 | 8/2016 | Leon y Leon |

FOREIGN PATENT DOCUMENTS

| | | | |
|---|---|---|---|
| CN | 103572411 | A | 2/2014 |
| CN | 104372445 | A | 2/2015 |
| EP | 0329128 | A2 | 8/1989 |
| EP | 0378381 | A2 | 7/1990 |
| GB | 1196599 | A | 7/1970 |
| GB | 1324041 | A | 7/1973 |
| GB | 1370366 | A | 10/1974 |
| GB | 2014971 | A | 9/1979 |
| GB | 2084975 | A | 4/1982 |
| JP | S58139645 | A | 8/1983 |
| JP | S62257422 | A | 11/1987 |
| JP | H0633531 | A | 2/1994 |
| JP | 2000336529 | A | 12/2000 |
| JP | 2001355120 | A | 12/2001 |
| JP | 3552953 | B2 | 8/2004 |
| JP | 2010159533 | | 7/2010 |
| JP | 5012089 | B2 | 8/2012 |
| JP | 5207796 | B2 | 6/2013 |
| JP | 2015183165 | A | 10/2015 |
| WO | 2013/060792 | A1 | 5/2013 |

OTHER PUBLICATIONS

Ismail et al: "A Review of Heat Treatment on Polyacrylonitrile Fiber, Article in Polymer Degradation and Stability, Polymer Degradation and Stability", 92(8):Apr. 14, 2007.

Frank et al: "Carbon Fibers: Precursors, Manufacturing, and Properties", Macromol. Mater. Eng. 2012, 297, 493-501, Jun. 2012.

Wang et al.: "Physical modification of polyacrylonitrile precursor fiber: its effect on mechanical properties." Journal applied of polymer science 52.12 (1994): 1667-1674.

Wang et al.: "Aspects on interaction between multistage stabilization of polyacrylonitrile precursor and mechanical properties of carbon fibers." Journal of applied polymer science 56.2 (1995): 289 300.

The making carbon of fiber/ http://www.compositesworld.com/blog/post/the-making?of?carbon-fiber (from 1988).

Liu, Y, Stabilization and carbonization studies of polyacrylonitrile/carbon nanotube composite fibers. Dissertation. Georgia Institute of Technology. 2010. [Retrieved on Feb. 14, 2017], <URL: https://smartech.gatech.edu/handle/1853/42933>. summary; table 5.6.

International Search Report from PCT/US16/69537 dated Mar. 17, 2017.

* cited by examiner

METHOD OF PRODUCING CARBON FIBERS FROM MULTIPURPOSE COMMERCIAL FIBERS

CROSS REFERENCE TO RELATED APPLICATIONS

This application is a non-provisional application of U.S. provisional patent application No. 62/273,559, filed Dec. 31, 2015, and U.S. provisional patent application No. 62/305,232, filed Mar. 8, 2016, both entitled "Method of Producing Carbon Fibers from Multipurpose Commercial Fibers", the disclosures of which are hereby incorporated fully by reference in their entireties.

STATEMENT REGARDING FEDERALLY SPONSORED RESEARCH

This invention was made with government support under contract No. DE-AK-00OR22725 awarded by the U.S. Department of Energy. The government has certain rights in this invention.

FIELD OF THE INVENTION

This invention relates generally to carbon fiber and carbon fiber production methods.

BACKGROUND OF THE INVENTION

Conventional carbon fiber processing methods use small untwisted bundles of filaments, or "tows," and low volumes of pre-stretched, fast-oxidizing polymer (with accelerants) or fibers that are composed with or incorporate an accelerant. The carbon fiber precursor materials for such processing methods are often specialty products intended specifically for carbon fiber production.

The automotive industry has not adopted widespread use of carbon fiber materials primarily because the cost of the carbon fiber material remains at relatively high specialty material prices, while widespread usage in automobile manufacturing would require relatively lower commodity pricing. While attaining such pricing, the material must meet the performance criteria required by the auto industry. The performance criteria prescribed by some automotive manufacturers for carbon fiber materials is that the material meet or exceed 400 ksi tensile strength and 40 Msi tensile modulus with at least 1% strain as minimum properties to encompass the automotive carbon fiber uses. In some semi-structural automotive composite applications carbon fibers with 250 ksi tensile strength and 25 Msi tensile modulus with at least 1% strain are sought.

Carbon fiber production begins with a carbonaceous precursor fiber material. A common carbonaceous precursor material is polyacrylonitrile (PAN). Specialty PAN precursor fibers are available with a variety of comonomers and accelerants. The comonomers are provided to impart desired properties to the precursor fiber and to the finished carbon fiber product. Commercial grade specialty acrylic fibers consist of a copolymer of acrylonitrile in combination with comonomers from various choices. The statistical copolymers usually contain 2-5 mol % comonomers. The comonomers are usually vinyl compounds with carboxylic acid (acrylic acid, methacrylic acid, itaconic acid) or their esters (methyl acrylate, methyl methacrylate) or their amides (acrylamide). These polymers are usually designed to have high molecular weight and narrow molecular weight distribution. These compositions are polymerized and solution spun into fiber form with significant draw down ratio (stretching), usually 14× or higher, achieved by steam stretching or other methods known in the art. Increased comonomer content helps to stretch and align the molecules along the fiber axis direction; however, that also increases the probability of chain scission during subsequent thermal processing of the carbon precursor fiber. Thus an optimally low comonomoner content is used. The fibers usually undergo thermal cyclization and oxidative crosslinking reaction at temperatures ranging from 180° C. to 300° C. These reactions are exothermic in nature and conventional art prefers to avoid overheating of the precursor fiber to control the chain scission reaction and melting of the fiber prior to rendering it to crosslinked intractable fiber. Overheating also causes thermal relaxation of the fiber and occasional ignition of the filaments. Thus keeping sufficient heat transfer in mind these specialty acrylic fibers are made of tow (bundle of filaments) of less than 80,000 filament counts.

Textile grade acrylic fibers are used in staple yarn form for clothing application. These fibers are also used in hand crafting (knitting and crochet), synthetic wool and flame resistant fabric applications. Because of its apparel usage, dying of the fiber is an important aspect. Thus chemical compositions mainly focus on comonomers that allow significant dye adsorption on the fiber surface. Vinyl acetate and methyl acrylate are commonly used comonomers with optional loading of vinyl chloride or vinylidene chloride for induction of flame retardant properties. Textile fibers are produced in large tow size (approx. 500,000 filament per tow or higher) and usually have lower molecular weight than the specialty acrylic carbon precursor fibers.

Textile PAN polymers are statistical copolymers of acrylonitrile polymerized in solvents such as dimethylformadide, dimethylsulfoxide, dimethylacetamide to produce a PAN solution that are processed directly to produce fiber without removal of the low-molecular weight oligomeric product. The presence of these low-molecular weight products in textile PAN fiber causes a broad molecular weight distribution in the commodity product, compared to the standard specialty acrylic PAN carbon precursor fibers (also known as specialty acrylic fibers or SAF). These textile fibers are not significantly stretched (3-5× draw-down ratio); rather at the end of a moderate degree of stretching the fibers are molecularly relaxed to obtain fiber with an unstrained amorphous phase where dye molecules can migrate to form colored textiles.

An important component of the carbon fiber production process is the oxidation/stabilization stage of the process. Accelerants are provided to accelerate the oxidation/stabilization process so as to reduce the time requirements for oxidation, which can be substantial and a time and production volume limiting factor of the carbon fiber production process.

The oxidation/stabilization process is complex and exothermic. In the case of PAN precursor fibers, upon heating the cyano side groups form cyclic rings with each other (cyclization reaction), and upon further heating in air these rings become aromatic pyridine. Oxygen molecules present in the air allows thermal dehydrogenation in cyclized rings to form the aromatic pyridine structures. Upon further heating adjacent chains join together to form ribbons, expelling hydrogen cyanide gas. Oxygen is also used to crosslink the ribbon structures through formation of ether linkages; oxidation is also known to form carbonyl and nitrone (nitrogen in cyclic structure bonds to atomic oxygen through dative bonding) structures. The stabilization process is highly exothermic and care must be taken to control or dissipate the generated heat.

During thermal oxidation the precursor polymer changes its structure in each oxidation zone due to cyclization and crosslinking reactions. The actual melt temperature of the polymer in fibers varies depending on the process conditions, and thermal history of the composition; however, in general the fusing temperature is higher after each pass in oxidation and the density of the fiber increases. To accomplish a higher rate of oxidation, temperatures in subsequent oxidation zones are gradually increased.

During the oxidation process the temperature of the fiber is required to maintain below its softening temperature to avoid inter-filament fusion. Sudden increases in the temperature of the filament lowers filament mechanical strength and often causes breakage of filaments that undergo mechanical stretch against extreme shrinkage force caused by cyclization and oxidative crosslinking reaction.

Stabilized PAN fibers with a high degree of oxygen uptake, to accomplish a high degree of crosslinking reactions, usually demonstrate increased fiber density. PAN precursor fibers have density of 1.18-1.20 g/cc; whereas oxidized PAN fibers can have densities in the range of 1.25-1.45 g/cc. Oxidized fibers with a high density range (>1.40 g/cc) exhibit significant flame retardancy.

After stabilization of the fibers, further heating in furnaces under inert ($N_2$) atmosphere (a process called carbonization) expels nitrogen gas along with oxygen containing compounds, and other volatile organic tar forming compounds to form the carbon fibers with a higher degree of aromatic chemical structures.

The desire to increase production volumes has led to the widespread use of pre-stretched, specialty precursor fibers which include accelerants for accelerating the oxidation reaction. The presence of accelerant functionalities enhances the kinetics of thermal cyclization reaction of PAN. The precursor fibers are arranged into tows of about 100,000 deniers less and are passed rapidly through the oxidation oven usually maintained in a hot air atmosphere. Heating is applied and controlled to also enable the oxidation reaction to proceed. The application of such external heat results in an energy cost to the process. The stored heat in these tows (i.e. the heat that evolves during cyclization and oxidation reactions) require the fiber to be spread thinly to a fiber loading concentration of 100,000 deniers or less per inch of width in the stabilization ovens. This low fiber loading concentration requirement in oxidation, to avoid inter-filament fusion caused by heat evolved during precursor fiber oxidation, is at least partially responsible for the high cost of carbon fiber.

SUMMARY OF THE INVENTION

A method of producing carbon fibers includes the step of providing polyacrylonitrile precursor polymer fibers (or filaments). The polyacrylonitrile precursor filaments include from 87-97 mole % acrylonitrile, and include less than 0.5 mole % of accelerant functional groups. The filaments can be no more than 3 deniers per fiber. The polyacrylonitrile precursor filaments are arranged into tows of at least 150,000 deniers per inch width. The arranged polyacrylonitrile precursor fiber tows are stabilized by heating the tows in at least one oxidation zone containing oxygen gas or air and maintained at a first temperature while stretching at least 10% to yield a stabilized precursor fiber. The stabilized precursor fiber is carbonized to produce carbon fiber or is used as flame retardant materials.

The carbon fiber that is produced by the invention can have a tensile modulus of at least 30 Msi. The carbon fiber can have a tensile strain of at least 1%.

The accelerant functional group can be an acid functional group that can initiate a cyclization reaction in the polyacrylonitrile segment of the precursor polymer. The accelerant functional group can be at least one selected from the group consisting of an amino group (—$NH_2$), a substituted amino group (—NH—), an amide group (—CO—NH—), carboxylic acid group (COOH) and a sulfonic acid group (—$SO_3H$) that can initiate cyclization reaction in the polyacrylinitrile segment of the precursor polymer. The accelerant functional group can be an electron donating functional group that can initiate the cyclization reaction in the polyacrylinitrile segment of the precursor polymer.

The polyacrylonitrile precursor polymer fibers or filaments can comprise from 91-94 mole % acrylonitrile. The polyacrylonitrile precursor polymer fibers can comprise at least 87 mole % acrylonitrile. The polyacrylonitrile precursor polymer fibers can comprise at least 88 mole % acrylonitrile. The polyacrylonitrile precursor polymer fibers can comprise at least 89 mole % acrylonitrile. The polyacrylonitrile precursor polymer fibers can comprise at least 90 mole % acrylonitrile. The polyacrylonitrile precursor polymer fibers can comprise at least 91 mole % acrylonitrile. The polyacrylonitrile precursor fibers can comprise at least 92 mole % acrylonitrile. The polyacrylonitrile precursor polymer fibers can comprise at least 93 mole % acrylonitrile. The polyacrylonitrile precursor polymer fibers can comprise at least 94 mole % acrylonitrile. The polyacrylonitrile precursor polymer fibers can comprise at least 95 mole % acrylonitrile. The polyacrylonitrile precursor polymer fibers can comprise at least 96 mole % acrylonitrile. The polyacrylonitrile precursor polymer fibers can comprise no more than 97 mole % acrylonitrile.

The polyacrylonitrile precursor polymer fibers or filaments can comprise no more than 96 mole % acrylonitrile. The polyacrylonitrile precursor polymer fibers can comprise no more than 95 mole % acrylonitrile. The polyacrylonitrile precursor polymer fibers can comprise no more than 94 mole % acrylonitrile. The polyacrylonitrile precursor polymer fibers can comprise no more than 93 mole % acrylonitrile. The polyacrylonitrile precursor polymer fibers can comprise no more than 92 mole % acrylonitrile. The polyacrylonitrile precursor polymer fibers comprise no more than 91 mole % acrylonitrile. The polyacrylonitrile precursor polymer filaments comprise no more than 90 mole % acrylonitrile. The polyacrylonitrile precursor polymer fibers can comprise no more than 89 mole % acrylonitrile. The polyacrylonitrile precursor polymer fibers can comprise no more than 88 mole % acrylonitrile.

The arranged precursor fiber tows can be between 150,000 deniers per inch width and 3,000,000 deniers per inch width. The arranged precursor fiber tows can be between 250,000 deniers per inch width and 3,000,000 deniers per inch width. The arranged precursor fiber tows can be between 500,000 deniers per inch width and 3,000,000 deniers per inch width.

The polyacrylonitrile precursor polymer fibers can comprise a comonomer that is polymerized with the acrylonitrile monomer. The comonomer can be at least one selected from the group consisting of methyl acrylate and vinyl acetate. The comonomer can be an acrylate or methacrylate compound.

The precursor fibers or filaments can be arranged into fiber tows comprising between 3000 and 3,000,000 precursor filaments. The precursor fiber count can be between 100,000 and 3,000,000 filaments per inch width.

The method can include a stretching step prior to the oxidizing step, the stretching step reducing the precursor fiber diameter. The carbonization step can include passing the stabilized precursor fiber tows through at least two carbonization zones. The first carbonization zone can be maintained at a temperature between 500-1000° C. and the second carbonization zone can be maintained at a temperature between 1000-2000° C.

The method can include the step of heating the tows in a second oxidation zone containing oxygen gas and maintained at a temperature T2, wherein T2 is less than a first temperature T1 of the first oxidation zone.

The method can include a sizing step after the carbonization step. The method can include a surface treatment step after the carbonization step.

The polyacrylonitrile precursor polymer fibers can be stretched between 100-600% during the oxidation process.

The throughput rate of precursor filament can be at least 900 deniers per inch width of oxidation zone, per minute. The throughput rate of precursor filament can be at least 1200 deniers per inch width of oxidation zone, per minute. The throughput rate of precursor filament can be at least 2,000 deniers per inch width of oxidation zone, per minute. The throughput rate of precursor filament can be at least 3,000 deniers per inch width of oxidation zone, per minute. The throughput rate of precursor filament can be at least 4,000 deniers per inch width of oxidation zone, per minute. The throughput rate of precursor filament can be at least 5,000 deniers per inch width of oxidation zone, per minute.

A method of producing carbon fibers can include the step of providing polyacrylonitrile precursor polymer fibers. The polyacrylonitrile precursor polymer fibers include from 87-97 mole % acrylonitrile and can include less than 0.5 mole % of accelerant functional groups. The precursor fibers can be no more than 3 deniers per precursor fiber. The polyacrylonitrile precursor fibers are arranged into at least 150,000 deniers per inch width. The arranged polyacrylonitrile precursor fiber are stabilized by heating the arranged precursor fibers in at least one oxidation zone containing oxygen gas and maintained at a first temperature while stretching the tows at least 10% to yield a stabilized precursor fiber. The method can further include the step of carbonizing the stabilized precursor fiber. The stabilized precursor fibers are intrinsically flame retardant in nature.

A method of producing flame retardant fibers includes that step of providing polyacrylonitrile precursor polymer fibers (or filaments). The polyacrylonitrile precursor fibers include from 87-97 mole % acrylonitrile, and include less than 0.5 mole % of accelerant functional groups. The precursor fibers can be no more than 3 deniers per filament. The polyacrylonitrile precursor fibers can be arranged into tows of at least 150,000 deniers per inch width. The arranged polyacrylonitrile precursor fiber tows can be stabilized by heating the tows in at least one oxidation zone containing oxygen gas and maintained at a first temperature while stretching at least 10% to yield a stabilized precursor fiber.

A method of producing stabilized fibers can include the steps of providing polyacrylonitrile precursor polymer fibers. The polyacrylonitrile precursor fibers include from 87-97 mole % acrylonitrile, and include less than 0.5 mole % of accelerant functional groups. The precursor fibers can be no more than 3 deniers per filament. The polyacrylonitrile precursor fibers are arranged into tows of at least 150,000 deniers per inch width. The arranged polyacrylonitrile precursor fiber tows are stabilized by heating the tows in at least one oxidation zone containing oxygen gas and maintained at a first temperature while stretching at least 10% to yield a stabilized precursor fiber.

A carbon fiber according to the invention can have a Herman orientation factor (S) of graphitic planes between 0.55-0.80, a tensile modulus of from 30 to 40 Msi, and a tensile strain of at least 1%. The carbon fiber can have a Herman orientation factor (S) of graphitic planes between 0.55-0.70, a tensile modulus of from 30 to 40 Msi, and a tensile strain of at least 1%. The carbon fiber can be PAN-based.

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

Figure 1:
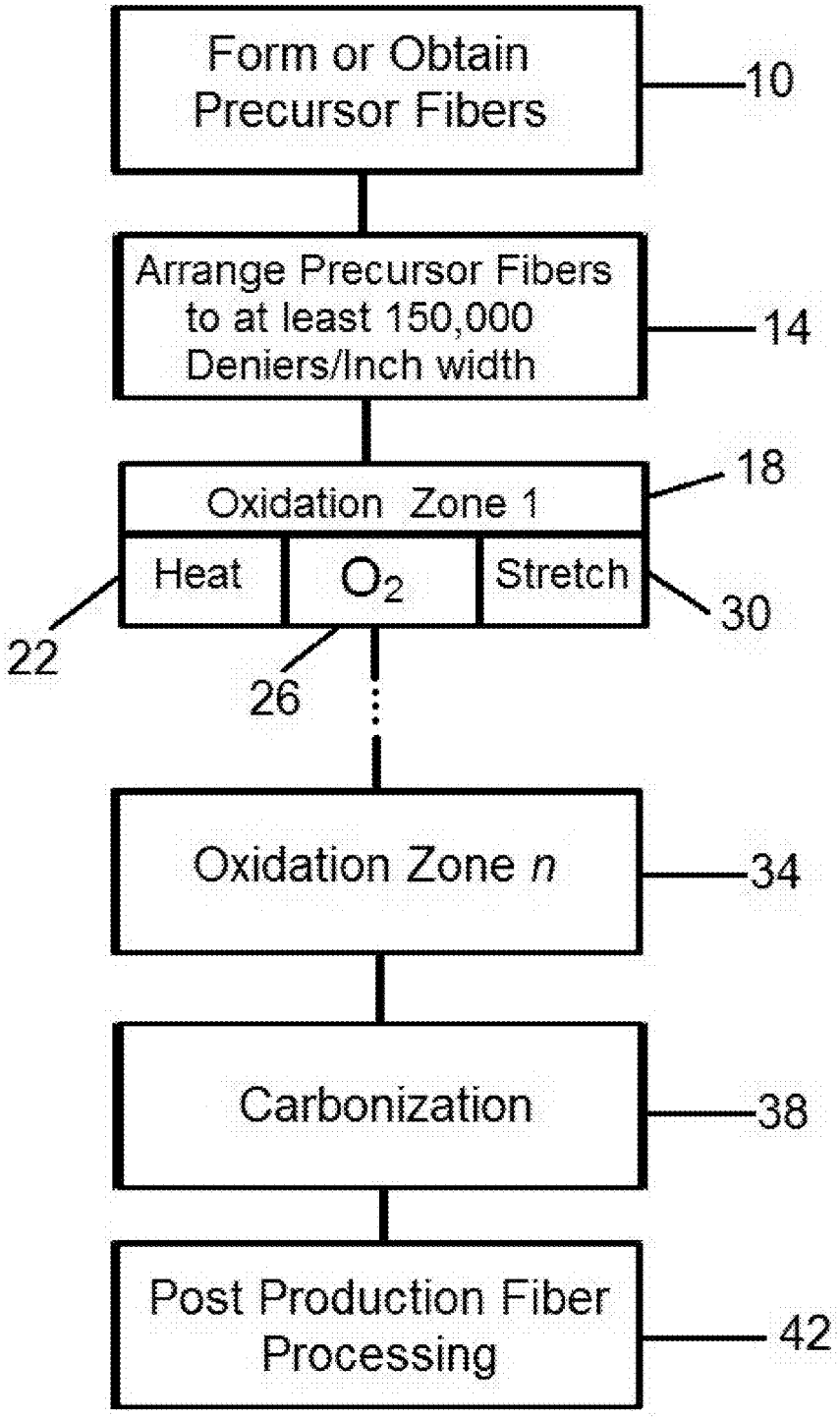
FIG. 1 a flow chart illustrating the method of the invention.

This invention relates to a method for producing carbon containing fibers, including but not limited to carbon fibers produced from a commercially available commodity precursor fiber that has been developed for multipurpose use. The production costs for the resultant carbon fibers using the methods of the invention can be less than fifty percent of traditional carbon fiber production methods.

A method of producing carbon fibers includes the step of providing polyacrylonitrile (PAN) precursor fibers. The PAN precursor fibers can be no more than 3 deniers per precursor fiber and comprise less than 0.5 mole % of accelerant functional groups, based on the total moles of all constituents in the composition of the PAN precursor fibers. The PAN precursor fibers can have from 87 mole %-97 mole % acrylonitrile. The PAN precursor fibers can be arranged into tows. Tows may be provided by the supplier of the precursor. The tows are formed in the spinning process, not in the conversion process. This application refers to "tows" in the broadest sense, as any inlet feedstock arrangement of PAN precursor filaments of at least 150,000 deniers per inch width. A denier is a measure of fiber dimension (linear density) used in the textile industry and is defined as grams of fiber weight per 9000 meters of fiber length. The terms fiber and filament as used herein for the polyacrylonitrile precursor fibers are used interchangeably.

The acrylonitrile content or AN content in PAN precursor cannot be nearly 100% or the fiber is not sufficiently stretchable and can't properly be oriented during the oxidation process, causing poor mechanical performance of the resultant carbon fiber. The AN content also cannot be too low or the fiber will fuse under reasonable, cost effective oxidation dwell times and conditions, again causing poor mechanical performance of the resultant carbon fiber.

The PAN and comonomer precursor fiber filament polymer can have from 88-97 mole % acrylonitrile. The PAN precursor fiber filaments can include from 90-95 mole % acrylonitrile, or from 91-94 mole % acrylonitrile. The acrylonitrile mole % content can be 87%, 88%, 89%, 90%, 91%, 92%, 93%, 94%, 95%, 96%, and 97% and can range from any low value to any high value among these values. The balance of the precursor fiber polymer can be the comonomer or a combination of comonomers.

The arranged PAN precursor fiber tows are stabilized by heating the tows in at least one oxidation zone containing oxygen-containing gas such as atmospheric air and maintained at a first temperature $T_1$ that is below the temperature of fusion of the precursor fibers, but sufficient to allow the oxidation reaction to proceed. The first temperature can in one example be at least 220° C. The fiber temperature must be maintained below the fusion temperature of the polymer formulation. In some cases, where the fiber fusion temperature is low (due to the fiber chemical composition) the first oxidation temperature can be at least 180° C. to maintain a balance between acceptable oxidation kinetics and elimination of possible fusion of filaments. The tows are stretched at least 10% during the oxidation stabilization step to yield a stabilized precursor fiber tow.

The stabilized precursor fiber tows are then carbonized by passing the stabilized precursor fiber tows through at least one carbonization zone maintained at suitable carbonizing conditions. The carbonization methods and equipment can be any suitable for carbon fiber production.

The term 'accelerant functional groups' as used herein refers to chemical moieties which participate in the reactions of the stabilization process and enhances the oxidation rate. Accelerant functional groups include but are not limited to carboxylic acid (—COOH) groups. Other accelerant functional groups include electron donating functional groups such as amino group (—$NH_2$), a substituted amino group (—NH—), an amide groups (—CO—NH—), or salt of all these accelerant groups that can initiate cyclization reaction in the polyacrylinitrile segment of the precursor polymer and fiber. Accelerant functional groups can also be a sulfonic acid (—$SO_3H$) group. When a constituent molecule of the polymer precursor contains more than 1 functional group (i.e., when multifunctionality exists in accelerant molecule) the mole percent of accelerant functional groups can be obtained by multiplying the mole % of the respective accelerant that is present times the number of accelerant functional groups that are present in the respective accelerant molecule.

Itaconic acid, for example, has two carboxylic acid accelerant functional groups in each molecule. The mole percent of accelerant functional groups can be obtained by multiplying the mole percent of itaconic acid in the precursor fiber composition by two. If the mole percent of itaconic acid in the precursor fiber is for example 0.1 mole %, the mole percent of accelerant functional groups would be 0.2 mole %. The mole % of accelerant functional groups can be less than 0.5%, 0.45%, 0.4%, 0.35%, 0.3%, 0.25%, 0.2%, 0.15%, 0.1%, 0.09%, 0.08%, 0.07%, 0.06%, 0.05%, 0.04%, 0.03%, 0.02%, 0.01%, 0.005%, or 0.001 mole %. The mole % of accelerant functional groups can also be 0%. The mole % of accelerant functional groups can be within a range of any high value and low value selected from these values. The minimum mole amount of accelerant functional groups can be 0, 0.001%, 0.01%, 0.02%, 0.03%, 0.04%, 0.05%, 0.06%, 0.07%, 0.08%, 0.09%, 0.1%, and 0%. The mole % of accelerant functional groups can be measured based upon the components of the precursor polymer, acrylonitrile and comonomer, however, if there are present other additives either embedded in or coating the precursor polymer fiber having accelerant functional groups, the mole % is measured based upon the total component moles of the acrylonitrile, comonomer(s), and additives.

Accelerants currently used in the industry and having accelerant functional groups include itaconic acid among many others. Other examples of suitable accelerants include acrylic acid, methacrylic acid, crotonic acid, ethacrylic acid, maelic acid, mesaconic acid, salts of these carboxylic acids (sodium and ammonium salts for example), acrylamide, methacrylamide, and amine containing groups or their salts.

The PAN precursor fibers commonly are made of copolymer formed with at least one comonomer in addition to the acrylonitrile monomer. Any comonomer in the copolymer composition that is suitable for carbon fiber production can potentially be utilized, however, comonomers having accelerant functional groups must be limited in content to less than 0.5 mole % accelerant functional groups. Common comonomers include acids such as acrylic acid, itaconic acid, and methacrylic acid, vinyl esters such as methyl acrylate, ethyl acrylate, butyl acrylate, methyl methacrylate, ethyl methacrylate, propyl methacrylate, butyl methacrylate, β-hydroxyethyl methacrylate, dimethylaminoethyl methacrylate, 2-ethylhexylacrylate, isopropyl acetate, vinyl acetate, and vinyl propionate; vinyl amides such as acrylamide, diacetone acrylamide, and N-methylolacrylamide;

vinyl halides such as allyl chloride, vinyl bromide, vinyl chloride, and vinylidene chloride (1,1-dichloroethylene), ammonium salts of vinyl compounds such as quaternary ammonium salts of aminoethyl-2-methylpropenoate. Other co-monomers are possible.

Other compounds in addition to PAN and comonomer polymer can be present in the precursor fiber which can impart desired properties to the carbon fiber product (accelerants, stabilizers plus some that do not enhance performance such as sodium, iron, and zinc residues from catalysts or inorganic salts used in aqueous solvent for PAN fiber generation). Such other compounds if containing accelerant functional groups must be limited such that the mole % of functional groups based upon all the total components of the precursor fiber does not exceed 0.5 mole %.

The precursor fiber of the invention can be a commodity precursor fiber such as is commonly used in the textile processing. Such fibers are readily available from most commercial PAN textile producers such as Aksa, Dolan, Dralon, Kaltex, Montefibre, Pasupati, Taekwang, Thai Acrylic, and numerous other companies. Typically, usable PAN textile fibers will be less than 3 deniers per filament (DPF), crimped or uncrimped, bright luster (no $TiO_2$), and continuous. All of these textile PAN fibers are typically manufactured in large tow sizes resulting in very high linear density of the fiber bundle.

Fiber fusing can be a fatal defect for successful oxidation and carbon fiber conversion and cannot be overcome or continued to completion after substantial fusing occurs. This means that the oxidation process must start and be maintained at a temperature of close to but below the fusing temperature during each stage of stabilization until sufficient oxidation and cross linking occur. This requires a very long and slow oxidation process that is directly proportional to the amount and type of co-monomer included in the polymer. Fiber fusion during the oxidation/stabilization process must be avoided for the oxidation/stabilization reaction to produce properly formed and stabilized fibers. Some fusion is inevitable and tolerable. There is a distinction that can be made between microscopic fusion and catastrophic fusion. Microscopic fusion is the term which applies to a small percentage of fiber that fuses, and that is difficult to completely avoid even under optimal conditions. Catastrophic fusion is the term which applies where a relatively large percentage of fiber fuses, leading to a failure in some portion of the product or even the entire production run. Preferably less than 5% of a length segment of the fiber is fused during the entire oxidation process (all ovens), or less than 4%, 3%, 2% or 1% in the case of microscopic fusion. Stretching during the oxidation/stabilization process helps to separate the fibers to avoid the fiber-to-fiber contact which promotes fusion.

Stretching during the oxidation/stabilization process of the invention avoids substantial fusion and can impart proper alignment and microstructure to the carbon fiber product. Stretching can be defined as the reduction in linear density (g/mm) of the precursor fibers. Control of stretching or tension on the fibers, especially in the thermal unit operations, is extremely important to achieving mechanical properties in PAN-based carbon fiber. Trials have shown ~3× increase in tensile strength between heat treatment without stretching and with optimal stretching for a high quality commercial precursor. Stretching is especially important in oxidation, both for development of mechanical properties and for controlling the rate of exothermic heat generation.

Oxidation of PAN fiber usually causes significant shrinkage force in the fiber. The lack of axial stress in the fibers during oxidation enhances the oxidation kinetics by allowing random intermolecular cyclization and rapid diffusion of oxygen through fiber cross sections due to relaxed molecular segments of PAN. The absence of axial tension (or absence of stretching) promotes enhanced rate of oxidation. However, such unoriented oxidized fiber products do not offer good properties in the resulting carbon fibers (i.e., tensile strength <250 ksi and tensile modulus <25 Msi). Stretching during oxidation is also important as that controls exothermic reaction, particularly for a process that involves inlet feedstock arrangement of PAN precursor filaments of at least 150,000 deniers per inch width.

Stretching can be accomplished by speed control. Stretching devices can be strategically located throughout the oxidation process. Each stretching device precisely controls the fiber line speed at that location. Stretch ratios are established by the speed ratio of successive stretching devices. Additionally, the ovens can be equipped with motor-driven "passback rolls" which enables fine-tuned stretch control during oxidation.

The amount of stretching in an oxidation zone can vary. In the first oxidation zone (zone 1), the stretching can be greater than 10%, or 11%, 12%, 13%, 14%, 15%, 16%, 17%, 18%, 19%, 20%, 21%, 22%, 23%, 24%, or 25%. Stretching in zone 1 can be up to about 100%. Stretching in zone 1 can be 10%-100%. Stretching is most important in zone 1 during the initial stages of the oxidation/stabilization process. Stretching in subsequent oxidation stages can usually be less than in the first oxidation/stabilization stage, because as cross-linking between the fibers progresses stretching becomes less desirable. Stretching can be accomplished by any suitable device or process. In one example stretching is accomplished by operating a downstream drive roller at a faster speed than an upstream drive roller.

The stretching during oxidation can vary from oxidation zone to oxidation zone. Stretching will usually, but not necessarily, be greater in the first oxidation zone than in subsequent oxidation zones. Stretching in any given oxidation zone will usually, but not necessarily, be greater than or equal to the stretching in a subsequent or downstream oxidation zone, and less than or equal to the stretching in the immediately preceding zone. The amount of stretching in an oxidation zone can be between 0-100%. For some textile PAN precursors that can stretch significantly can be stretched up to 200%. The amount of stretching in an oxidation zone can be 0%, 5%, 10%, 15%, 20%, 25%, 30%, 35%, 40%, 45%, 50%, 55%, 60%, 65%, 70%, 75%, 80%, 85%, 90%, 95%, 100%, 105%, 110%, 115%, 120%, 125%, 130%, 135%, 140%, 145%, 150%, 155%, 160%, 165%, 170%, 175%, 180%, 185%, 190%, 195%, or 200%, or a range of any high and low among these. In one example, not wishing to be limited thereby, in a four oxidation zone process the stretching can be 80-100% in zone 1, 65% in zone 2, 20% in zone 3, and 0% in zone 4. Stretching can be less in later oxidation stages because fusion becomes less likely and more difficult as the oxidation and cross-linking of the filaments progresses. The amount of stretching in the overall (all oxidation zones) oxidation process can vary. The amount of stretch through the overall oxidation/stabilization process can be 100-600%, 200-500%, or 300-400%. More or less stretching in the overall process is also possible.

The method can also include a stretching step prior to the oxidizing step (preoxidation-stretching or often called pre-stretching). This stretching step reduces the filament diameter prior to the oxidation process. The amount of this prestretch if present can be between 5% and 150% and is in addition to the stretching that is typically used to make the textile precursor fiber.

Significant stretching during oxidation can result in the fiber exiting the oxidation zone very quickly due to the rapid increase in fiber length by the applied stretch. Where significant (for example, more than 100%) stretching is desirable, a pre-stretching step can be performed before feeding the fiber to the oxidation step. This will permit a suitable fiber residence time in the oxidation zone to conduct a discernible degree of oxidation in the fiber, while also permitting some additional stretching in the oxidation zone. The pre-stretching can be performed at a suitable temperature, for example at temperatures ranging between the fibers' glass transition temperature (Tg) and softening point, but under conditions where significant oxidation of the fiber does not occur. Depending on the particular composition, the Tg of PAN precursor fibers are typically in the range of 80-105° C. The prestretching temperature can be at or below the first oxidation zone temperature, for example 230° C. The prestretching temperature can be between 130-230° C. Any suitable heating means can be used for the prestretching. It is possible to use heated godet rollers to both heat and prestretch the fibers. In that case a second heated godet roller rotates at a faster speed than a first heated godet roller.

The number of oxidation zones can vary depending on the process characteristics. There can be 1, 2, 3, 4, 5, 6, 7, 8, 9, 10, 11, 12, 13, 14 or 15 oxidation zones. More or fewer oxidation zones are possible.

The term oxidation zone as used herein is defined by an area in which one part of the oxidation process is distinguished from other parts of the oxidation process by process characteristics such as temperature, stretching, oxygen flow, and characteristics of the precursor filaments. Separate oxidation zones allow for more precise control of oxidation process parameters throughout the oxidation process. An oxidation zone can be defined by a physical boundary such as the boundaries of a single oven, or by a location within an oven. More than one oxidation zone can be housed within a single oxidation oven, and more than one physical oxidation oven can be used. According to common current practice, multiple oxidation ovens are arranged sequentially. The fiber can make one or several passes through an oxidation zone. Any number of oxidation zones is possible. Multiple passes through each oxidation zone is commonly used. The number of passes through an oxidation zone can be 1, 2, 3, 4, 5, 6, 7, 8, 9, 10, 11, 12, 13, 14, 15, 16, 17, 18, 19, 20, 21, 22, 23, or 24 or a range of any high or low from these.

The method can further include the step of performing oxidation/stabilization of the tows in at least one additional oxidation zone. The operating parameters of subsequent oxidation zones can vary according to process parameters including the precursor fiber size and composition, desired throughput, and desired carbon fiber product characteristics. A second oxidation zone can be provided containing oxygen containing gas such as atmospheric air. The second oxidation zone can be maintained at a temperature $T_2$, wherein $T_2$ is less than the temperature in a previous zone, or $T_1$ (for example, $T_2-T_1$ is negative). In some cases, the difference in temperatures between zone 2 and zone 1 (i.e., $T_2-T_1$) is −5° C. In some cases, $T_2-T_1=-10°$ C. In some cases, $T_2-T_1$ can be 0° C. (i.e., $T_2=T_1$). In specific cases the $T_2-T_1=-1°$ C. The temperature in an oxidation zone $T_{n+1}$ can be the same or lower than the temperature in a prior, upstream oxidation zone $T_n$, such that $T_{n+1}-T_n$ can be 0, −1, −2, −3, −4, −5, −6, −7, −8, −9, −10, −11, −12, −13, −14, −15, 16, −17, −18, −19, −20, −21, −22, −23, −24, or −25° C., or within a range of any high and low value selected from these. In general, the temperature of the final oxidation zone $T_f$ will be higher than the temperature in the initial oxidation zone $T_1$. In some examples, $T_f-T_1$ can be anywhere from 0 to +70° C. In some examples, $T_f-T_1$ can be anywhere from 0 to +30° C. In some examples, $T_f-T_1$ can be anywhere from 0 to +10° C. In some examples, $T_f-T_1$ can be anywhere from 0 to +5° C.

The prior art shows that it is not common that a second oxidation zone is operated at a temperature less than the first oxidation zone. Conventional wisdom suggests maintaining oxidation temperature in zone 2 ($T_2$) higher than the temperature of the first oxidation zone ($T_1$). The escalation of oxidation zone temperatures in prior art processes continues throughout the oxidation process. This is a common practice as the process aims to enhance the kinetics of the oxidation operation in subsequent steps. It is also common in the prior art that after the oxidation, in first zone, the filaments form a skin of partially oxidized PAN surrounding an un-oxidized core where the oxygen is yet to diffuse through the partially oxidized and crosslinked PAN (the sheath material). For conventional specialty acrylic fiber (SAF) PAN precursors maintaining $T_2>T_1$ is, specifically, a requirement. Such specialty acrylic fibers or SAF-PANs (conventional PAN carbon fiber precursor with significant accelerant functionalities) are oxidized in zone 2 at higher temperatures than that of the zone 1 temperature (i.e., $T_2>T_1$ for SAF). This is because the presence of accelerant functional group causes cyclized and partially crosslinked sheath structure that imposes resistance to oxygen's diffusion to the core in order to achieve a uniform degree of oxidation across fiber diameter. An increase in zone 2 temperature also enhances the rate of oxidation and thus, the process economics. However, oxidation is still an exothermic process, and to avoid filament melting or breakage and inter-fiber fusion, heat dissipation is a top priority. Therefore, inlet feedstock arrangement of these conventional SAF-PAN precursor filaments is maintained significantly less than the 150,000 deniers per inch width. Attempts to feed conventional SAF-PAN precursor filaments (containing >0.5 mole % accelerant) at 150,000 deniers per inch width cause vigorous exothermic reaction and filament breakage with ignition and combustion of the partially oxidized tow.

In general, the prior art shows the operating temperature of the oxidation zones increases downstream as the oxidation/stabilization process progresses. Subsequent oxidation zones can be operated at the same or different temperatures. In each oxidation zone, the objective is to advance the oxidation/stabilization process of the precursor fibers while avoiding fusion and properly orienting the fibers by stretching. In later oxidation zones fusion and orientation are less of a concern as the oxidation/stabilization process at these stages has advanced to the point where stretching is not required or may be detrimental. At the end of oxidation the precursor tow becomes mostly infusible and ready to form nonporous carbon fiber with oriented graphitic morphology.

The arranged precursor fiber tows entering the first oxidation zone can be between 150,000 (150 k) deniers per inch width and 3,000,000 (3M) deniers per inch width. The arranged precursor fiber tows can be between 250 k deniers per inch width and 3 M deniers per inch width. The arranged precursor fiber tows can be between 500 k deniers per inch width and 3 M deniers per inch width. The arranged precursor fiber tows (in deniers per inch width) can be 150 k, 175 k, 200 k, 225 k, 250 k, 300 k, 400 k, 500 k, 600 k, 700 k, 800 k, 900 k, 1 M, 1.1 M, 1.2 M, 1.3 M, 1.4, 1.5, 1.6 M, 1.7 M, 1.8 M, 1.9 M, 2 M, 2.1 M, 2.2 M, 2.3 M, 2.4 M, 2.5 M, 2.6 M, 2.7 M, 2.8 M, 2.9 M, and 3.0 M, or a range of any high and low among these.

The precursor fiber tows can include between 3000 and 3,000,000 precursor fibers-per-tow. More or fewer fibers-per-tow are possible. For some fibers the tow size can be 6,000 to 60,000, while for other fibers the tow size can be 70,000 to 200,000 fibers-per-tow. The tow size can be 400,000 to 600,000 fibers-per-tow, or 800,000 to 1,200,000 fibers-per-tow. The fibers-per-inch-width can be between 100,000 and 3,000,000. The fibers-per-inch-width can be 200 k, 300 k, 400 k, 500 k, 600 k, 700 k, 800 k, 900 k, or 1,000,000 for some fibers, or a range of high and low values from these.

The precursor fibers can be less than 3 deniers per filament (DPF). The precursor fibers can be 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, and 3 deniers per precursor fiber, or a range of any high and low among these. The fiber filaments can be no more than 3 deniers per filament. The minimum fiber dimension can be between 0.8 to 1.2 deniers per precursor fiber (filament).

The invention can be used with precursor fibers that are in excess of 3 DPF, so long as the fibers are reduced by prestretching or other suitable means to no more than 3 DPF. In case the precursor fibers are larger than 3 DPF, those would require a preoxidative hot stretching to form smaller linear density (DPF) and smaller fiber cross-section prior to feeding through oxidation zone 1. The upper limit of 3 DPF fiber linear density is required to obtain adequate oxidation of precursor within a reasonable time through diffusion of oxygen across the filament diameter.

The airflow or $O_2$ flow through the oxidation zones can be controlled. The airflow can be recirculated with makeup airflow. The direction of airflow can be cross flow, parallel flow, down flow, or any other suitable direction relative to fiber movement through the oxidation zone. The exhaust air flow can be controlled. Exhaust and make-up air volumetric flow must be balanced to prevent excessive leaks from the oxidation zone and sufficient in cubic feet per minute (CFM) to prevent an explosive or highly volatile flammable gas concentration in the oxidation zones.

Figure 5:
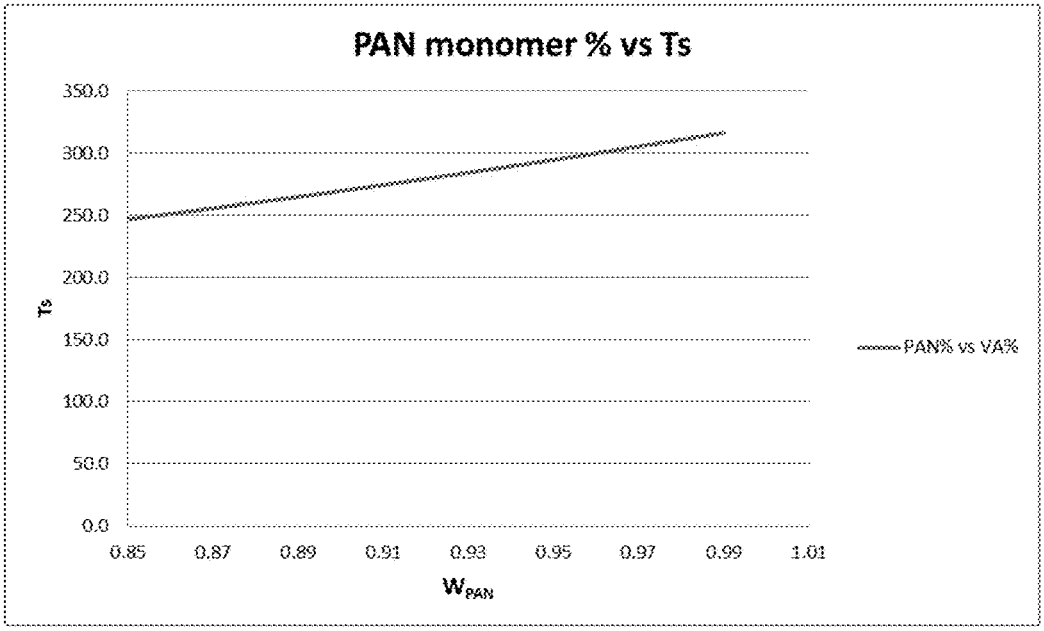
FIG. 5 is a plot of PAN weight % vs softening point ($T_s$) for a precursor fiber composition with a vinyl acetate comonomer.
Figure 6:
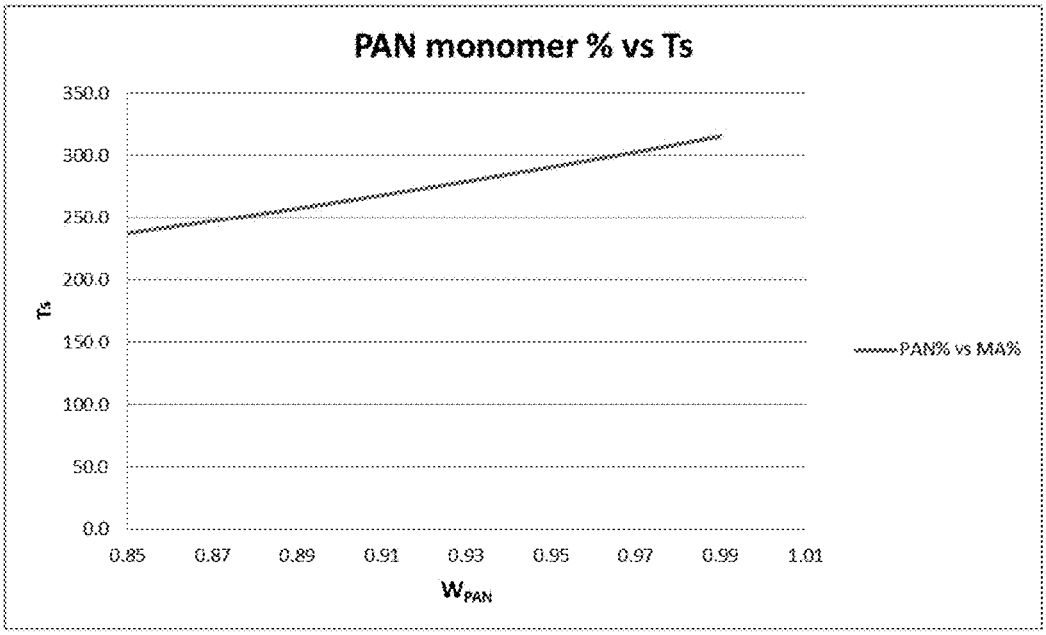
FIG. 6 is a plot of PAN weight % vs softening point ($T_s$) for a precursor composition with a methyl acrylate comonomer.

The temperature of the oxidation zones, and especially the first oxidation zone, must be maintained so as to avoid fiber-to-fiber fusion. The melt temperature of different precursor fiber formulations can be calculated using modified Fox-Flory equation i.e., $\mathbf{1}/Ts=w_1/Ts_1+w_2/Ts_2$; where Ts is the softening point of resulting compositions of w1 fraction of component 1 and w2 fraction of component 2, $Ts_1$ and $Ts_2$ are the softening points of component 1 and 2, respectively]. This theoretical softening point data can assist in determining the fusion temperature of a formulation. The polymer, however, changes after each heating step due to structural changes associated with cyclization and crosslinking reactions. The actual melt temperature will be variable depending on the process conditions, and thermal history of the composition, however, in general the fusing temperature will be higher after each pass in oxidation and the density of the fiber increases. There is shown in Table 1 a table of PAN monomer (acrylonitrile) content (weight %) vs $T_s$ (softening point or glassy to rubbery transition temperature Tg) where vinyl acetate is the comonomer and makes up the balance of the formulation (this relationship is shown graphically in FIG. 5). In this case Tg of pure polyvinyl acetate is 30° C. or 303 K. The fusion temperature of PAN is 322° C. or 595 K. There is shown in Table 2 a table of PAN monomer content (weight %) vs $T_s$ where methyl acrylate is the comonomer and makes up the balance of the formulation (this relationship is shown graphically in FIG. 6). In this case Tg of pure polymethyl acrylate is 10° C. or 283 K. The oxidation reaction is exothermic and the fiber temperature will exceed the oxidation zone temperature usually by at least 5° C., depending on the mass of the fiber. The oxidation zone temperature is set empirically by determining if the fiber is fusing upon exit from the oxidation zone, either by examination or even by feeling the tow. Also, the density of the fiber after each zone can be measured.

TABLE 1

Theoretical equivalent softening point (Ts) of acrylonitrile-vinyl acetate copolymer.

| Equivalent Ts of the copolymer | (1-PAN & 2-PVA) Softening Temperature (in K) | | Weight fractions | |
|---|---|---|---|---|
| Formulation | Ts1 | Ts2 | w1 - PAN | w2 - PVA |
| 246.8 | 595.2 | 303 | 0.85 | 0.15 |
| 251.2 | 595.2 | 303 | 0.86 | 0.14 |
| 255.7 | 595.2 | 303 | 0.87 | 0.13 |
| 260.3 | 595.2 | 303 | 0.88 | 0.12 |
| 264.9 | 595.2 | 303 | 0.89 | 0.11 |
| 269.7 | 595.2 | 303 | 0.9 | 0.1 |
| 274.5 | 595.2 | 303 | 0.91 | 0.09 |
| 279.4 | 595.2 | 303 | 0.92 | 0.08 |
| 284.4 | 595.2 | 303 | 0.93 | 0.07 |
| 289.5 | 595.2 | 303 | 0.94 | 0.06 |
| 294.6 | 595.2 | 303 | 0.95 | 0.05 |
| 299.9 | 595.2 | 303 | 0.96 | 0.04 |
| 305.3 | 595.2 | 303 | 0.97 | 0.03 |
| 310.7 | 595.2 | 303 | 0.98 | 0.02 |
| 316.3 | 595.2 | 303 | 0.99 | 0.01 |

TABLE 2

Theoretical equivalent softening point (Ts) of acrylonitrile-vinyl acetate copolymer.

| Equivalent Ts of the copolymer | (1-PAN & 2-PMA) Softening Temperatures (in K) | | Weight fractions | |
|---|---|---|---|---|
| Formulation (° C.) | Ts1 | Ts2 | w1 - AN | w2 - MA |
| 237.5 | 595.2 | 283 | 0.85 | 0.15 |
| 242.4 | 595.2 | 283 | 0.86 | 0.14 |
| 247.4 | 595.2 | 283 | 0.87 | 0.13 |
| 252.4 | 595.2 | 283 | 0.88 | 0.12 |
| 257.6 | 595.2 | 283 | 0.89 | 0.11 |
| 262.9 | 595.2 | 283 | 0.9 | 0.1 |
| 268.3 | 595.2 | 283 | 0.91 | 0.09 |
| 273.7 | 595.2 | 283 | 0.92 | 0.08 |
| 279.3 | 595.2 | 283 | 0.93 | 0.07 |
| 285.1 | 595.2 | 283 | 0.94 | 0.06 |
| 290.9 | 595.2 | 283 | 0.95 | 0.05 |
| 296.9 | 595.2 | 283 | 0.96 | 0.04 |
| 302.9 | 595.2 | 283 | 0.97 | 0.03 |
| 309.2 | 595.2 | 283 | 0.98 | 0.02 |
| 315.5 | 595.2 | 283 | 0.99 | 0.01 |

The process of the invention provides for higher material volumes by utilizing inlet feedstock arrangements of particular PAN precursor filaments of at least 150,000 deniers per inch width, while maintaining a set point of at least one subsequent oxidation zone temperature unexpectedly at lower value than the corresponding SAF-PAN conventional oxidation process. The invention has potential to be beneficial in terms of utility cost per unit mass processed.

Materials throughput in a turnkey continuous carbon fiber production line involving multiple oxidation and carbonization zones depends on the capacity of the production line. The capacity in turn depends on the size of oxidation ovens. If the materials throughput per unit width of oxidation zone 1 is measured, it will depend on the speed at which the material is fed through the system. The oxidation kinetic parameter(s) of a precursor depend(s) on the chemistry of the precursor (for example, presence or absence of an accelerant functional group and its concentration in mole %). For a specific precursor the residence time requirement in an oxidation process is more or less constant at a specified process window (temperature and stretch requirement). Therefore, the speed at which the precursor material can be fed through an oxidation zone or combination of zones will depend on the heated length of the oxidation zones. To quantify a material throughput per unit time and per unit width of an oxidation zone, one needs to normalize it with respect to oxidation heated length. Materials throughput per unit time can be fiber packing density in denier per unit width of oxidation zone normalized with respect to residence time needed to complete oxidation at that zone.

The material throughput is quantified by the product of fiber packing densities (given by deniers per inch width of the oxidation zone 1 inlet) and fiber speed (in meter/min) at zone 1 per unit heated length, as determined by the sum of the oxidation zone lengths required to accomplish the entire oxidation process. For simplicity, heated length can be the sum of all oxidation zone lengths in entire oxidation process. Thus, the throughput is:

[oxidation zone 1 inlet fiber arrangement (deniers/inch width)*fiber speed at the entrance of zone 1 (meter/min)]/[fiber heated length from the sum of all oxidation zone lengths in entire oxidation process (meter)]=values in denier/inch of oxidation oven width/min The throughput can also be expressed in kilogram of precursor fiber processed per hour per unit surface area of heated tow band.

For example, when 5 tow bands of 457,000 filament tow of 2 DPF textile precursor fiber are fed through a 12-inch width of oxidation zone 1 at 0.38 meter/minute speed for the required oxidation through 154 meter heated length of the entire oxidation path, the throughput can be determined by:

(5 tow*457,000 filaments/tow*2 denier/filament*0.38 meter/min)/(12-inch width*154 meter heated length)=939.7 denier per inch width of oxidation zone per min.

This is equivalent to:

[939.7 gram/9000 meter]/inch width per min=[939.7 gram*60 min/hour/9000 meter]/inch width per hour=6.26 g/inch width/meter heated length/per hour The same turnkey equipment could process an arrangement of 24 tows of 1.30 denier per filament SAF-PAN tows of 24,000 filaments per tow across 12-inch width of oxidation zone 1 at 1.7 meter/min inlet speed. This results throughput for SAF-PAN:

(24 tow*24,000 filaments/tow*1.30 denier/filament*1.7 meter/min)/(12-inch width*154 meter heated length)=688.8 denier per inch width of oxidation zone per min.

This data suggests that the process of the invention provides nearly 36.4% [(939.7*100/688.8)−1] increase in materials throughput for textile precursors when compared to the processing of SAF-PAN precursor through the same equipment.

In specific examples 3 tow bands of 533,000 filament tow of 2 DPF textile precursor fiber could be fed through a 6-inch width of oxidation zone 1 at 0.40 meter/minute speed for required oxidation through 154 meter heated length of entire oxidation path. For such a process, the throughput can be determined as follows:

(3 tow*533,000 filaments/tow*2 denier/filament*0.40 meter/min)/(6 inch width*154 meter heated length)=1384.4 denier per inch width of oxidation zone per min This is more than 100% improvement by the invention in materials throughput for textile PAN precursor in the same equipment compared to the baseline case of SAF-PAN processing methodology.

The process of the invention provides at least 900 deniers per inch width of oxidation zone, per minute precursor material throughput rate. In specific example, the process of the invention provides at least 1200 denier per inch width of oxidation zone, per minute precursor volume throughput rate. In some example, the process of the invention provides at least 2,000 denier per inch width of oxidation zone, per minute precursor material throughput rate. The throughput rate of precursor filament can be at least 3,000 deniers per inch width of oxidation zone, per minute. The throughput rate of precursor filament can be at least 4,000 deniers per inch width of oxidation zone, per minute. The throughput rate of precursor filament can be at least 5,000 deniers per inch width of oxidation zone, per minute. The throughput rate can be at least 900, 1000, 1100, 1200, 1300, 1400, 1500, 1600, 1700, 1800, 1900, and 2000, 2100, 2200, 2300, 2400, 2500, 2600, 2700, 2800, 2900, 3000, 3100, 3200, 3300, 3400, 3500, 3600, 3700, 3800, 3900, 4000, 4100, 4200, 4300, 4400, 4500, 4600, 4700, 4800, 4900, 5000 denier per inch width of oxidation zone, per minute, or within a range of any high and low value selected from these values.

The process of the invention provides at least 30% increase in materials throughput rate for less than 0.5 mol % accelerant group containing textile precursors through a turnkey continuous carbon fiber production line involving multiple oxidation and carbonization zones when compared to processing of SAF PAN precursors containing either higher AN content (>97 mole %) or higher accelerant function group content (>0.5 mole %) or both.

The carbonization steps can be any suitable carbonization process and can be performed by any suitable carbonization equipment. The carbonization process and temperatures can vary with the other process characteristics and the characteristics of the precursor filaments that are being processed. In one example the carbonization is performed by subjecting the stabilized precursor fiber tows to at least 500° C. in the absence of oxygen to produce carbon fiber tows. The carbonization can include more than one carbonization zone. A first carbonization zone can be operated at a lower temperature than a second or subsequent carbonization zone. For example, a first carbonization zone can be operated at between 500 to 1200° C., and a second carbonization zone can be operated at between 700 to 3,000° C. The first carbonization zone can be maintained at a temperature between 500-1000° C. and the second carbonization zone can be maintained between 1000-2000° C.

Carbonization usually takes place in an inert process environment, and at temperatures that are higher than the oxidation/stabilization process. Carbonization can be performed in any suitable device or single furnace, and with a single pass. A series of furnaces and multiple passes are possible. Temperature profiles can be stepped from furnace to furnace. Tension can be controlled. The fibers can be cooled before exiting each furnace to prevent degradation and/or combustion of fibers. Chemically enhanced carbonization is also possible. The treatment can be performed to heal surface defects and to grow carbonaceous structures on surface. The fibers can be cooled before exiting the carbonization process to the atmosphere to prevent degradation and/or combustion of fibers.

The carbon fiber produced by the invention can have a tensile modulus of at least 25 Msi, or at least 30 Msi, or at least 35 Msi, or at least 40 Msi. The tensile strength of carbon fiber produced by the invention can be up to 600 ksi or more. The carbon fiber produced by the invention can have a tensile strain of at least 1%. The carbon fiber produced by the invention can have a tensile strain of at least 0.8%.

Control and treatment of air flow into and/or out of ovens and furnaces can be performed to remove tars and other toxins. This will prevent tar and other contamination buildup in ovens and furnaces, and from being exhausted to the atmosphere.

Various post production carbon fiber processing steps are known and are suitable for carbon fibers produced according to the invention. A sizing step can follow the carbonization step. A surface treatment step can be provided after the carbonization step.

The carbon fiber conversion process of the invention can include steps used in current carbon fiber processing methodologies. The starting material can be a spooled carbon fiber precursor or a non-spooled (piddled) textile polymer fiber. The precursor fiber can be crimped or uncrimped. The process can include creeling. The fibers can be removed from packaging to begin initiating process feed.

There are many possible pretreatment options for precursor fiber that are known in the carbon fiber manufacturing and can also be utilized for the invention. These include rinsing, sizing, de-sizing, dis-entanglement, drying (if fibers are wet), and pre-stretching.

Chemical stabilization in addition to oxidation stabilization can be utilized. This can be part of a flexible process sequence. The chemical stabilization can be before stretching and/or oxidative stabilization, or can be concurrent with stretching and/or oxidative stabilization, and can be after stretching and/or oxidative stabilization. A gaseous reactant or liquid reactant (pickle line) can be used.

Tensioning can be utilized to control shrinkage. Further stretching can be performed to prevent entanglement. Optional de-coupling (an interruption of the continuous production process) can be used to produce an intermediate fiber product. The intermediate fiber product can be processed by piddling or winding into box or onto storage spool. The intermediate fiber product can be transported to a different location for further processing, such as carbonization. The intermediate fiber product can then be further processed by initiating process feed (re-creeling) and introduce constant tension. The intermediate fiber made according to the methods described herein possess flame retardant characteristics, and can be used in a number of applications including, but not limited to, building insulation, draperies, furniture, clothing, decorative fabrics, glover, outdoor tents and canopies, vehicle covers, camouflage materials, and fire-fighting equipment and accessories.

The stabilized or oxidized fibers can be stored for future consumption or carbonization. Pre-carbonization treatment is possible. Chemical treatment such as with inert gas, carbonaceous gas, nitrogen, and other suitable reactant gas can be used. Heat can be applied to drive off water or chemically modify the fibers. Post-carbonization operations can include secondary growth of carbon structure on the carbon fiber surface by use of conventional methods such as growth of carbon nano structures by chemical vapor deposition or catalytic growth of carbon by use of carbon precursor gas such as acetylene.

Surface treatment of the carbon fiber product is well-known and conventional processes can be utilized, such as electrolytic, chemical, and ozone treatments. Suitable sizing can be applied to the carbon fiber product. Any suitable sizing is possible, including the application of various polymers with secondary drying or dry and/or cure sizing. The process can be concluded with known terminal procedures such as piddling or winding into box or onto storage spool, and packaging.

The entire process or any part of the process can be controlled by a suitable processor or computer control. Any suitable processor or computer control is possible, and can be provided by the equipment manufacturer or installer.

There is shown in FIG. 1 a flow chart illustrating the process. The precursor fiber can be made or obtained from a suitable source in step 10. The precursor fiber is then arranged into a feedstock or tows of at least 150,000 deniers per inch width in step 14. An initial oxidation step 18 can include the application of heat 22, $O_2$ or air contact 26, and stretching 30 of the precursor fiber. Any number of subsequent oxidation zones n are possible and shown in step 34. Oxidation/stabilization is followed by carbonization in step 38. The resulting carbon fiber can be treated with one or more post-production treatment steps 42.

Figure 2:
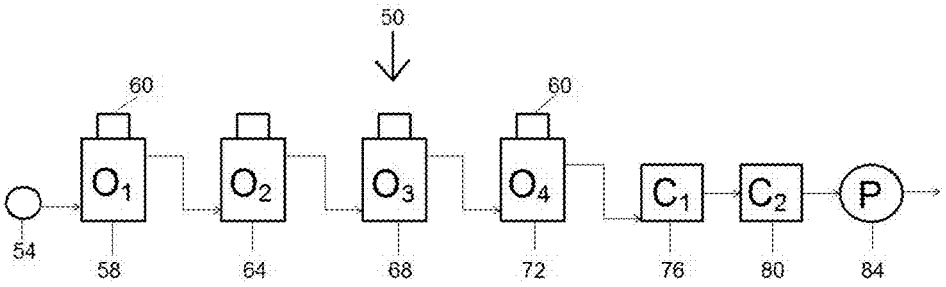
FIG. 2 is a schematic diagram of a carbon fiber production system according to the invention.

A schematic diagram of a system for performing the process is shown in FIG. 2. The system 50 initiates at start 54 where the precursor fiber is arranged into tows of at least 150,000 deniers per inch width. The precursor fiber tows enter the first oxidation zone $O_1$ 58, where the tows are treated with heat, air or $O_2$, and stretching. The tows are then passed to subsequent oxidation zones such as zone $O_2$ 64, zone $O_3$ 68, and zone $O_4$ 72, although more or fewer oxidation zones are possible. The stabilized fiber then passes to one or more carbonization zones such as low temperature (LT) carbonization zone $C_1$ 76 and high temperature (HT) carbonization zone $C_2$ 80. Carbon fiber exits the carbonization zones and can then be passed to one or more post-production treatment steps collectively illustrated as device P 84.

Figure 3:
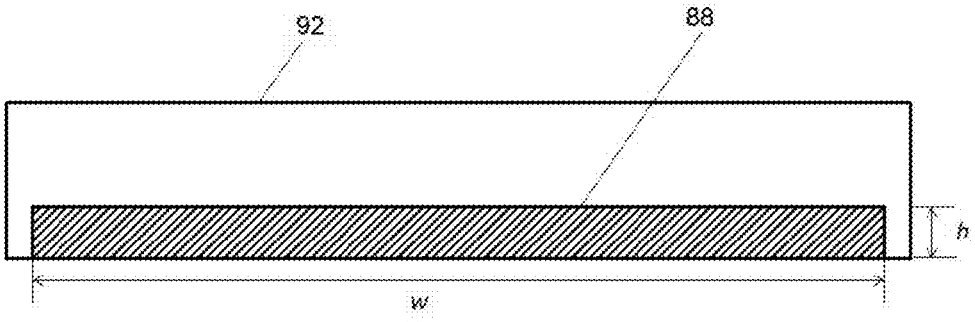
FIG. 3 is a schematic diagram of precursor fiber entering an oxidation zone.

The inlet to the first oxidation zone is shown schematically in FIG. 3. The tow 88 is shown positioned in inlet 92 of the oxidation/stabilization oven. The tow 88 has a height h and a width w. The packed fiber content is at least 150,000 deniers per inch width w.

Figure 4:
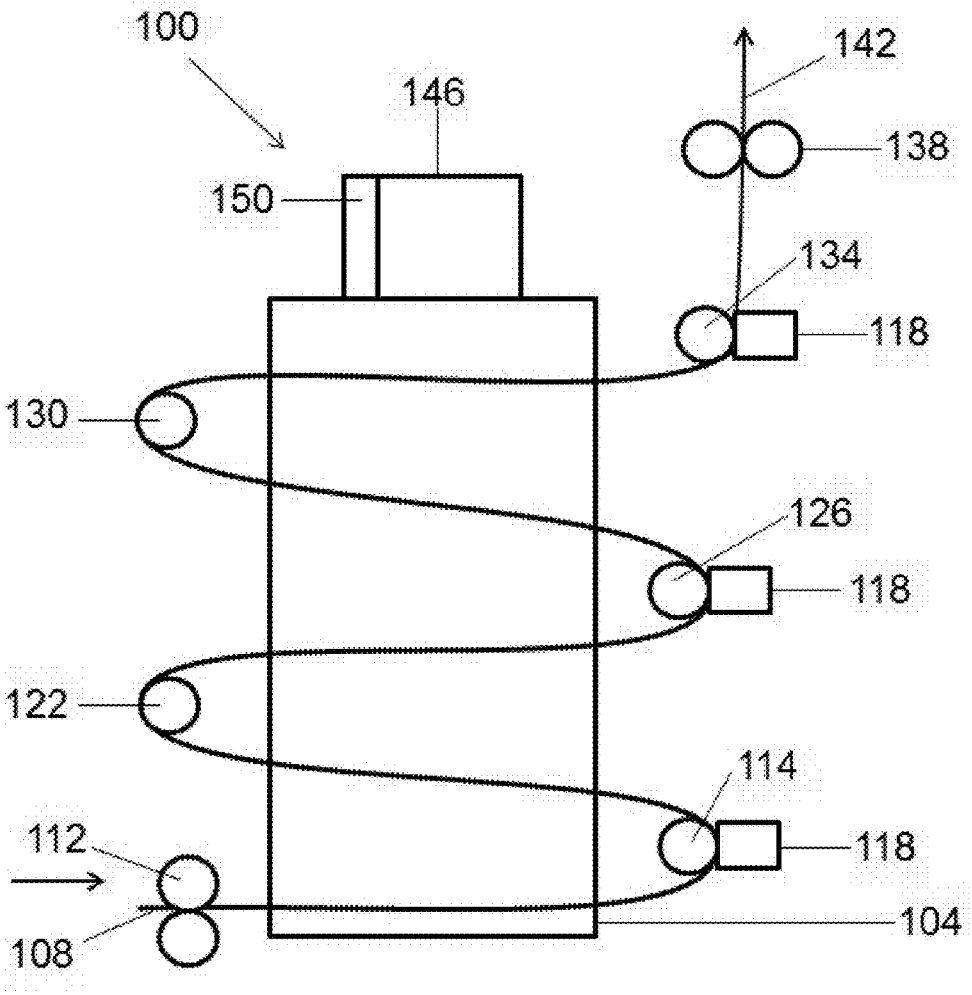
FIG. 4 is a schematic diagram of an oxidation zone.

A schematic diagram of an oven 100 useful for the invention is shown in FIG. 4 and can include an outer housing 104 defining the oxidation zone. The inlet fiber tow 108 can pass through an entry roller 112 and is pulled through the oxidation zone by an initial drive roller 114 powered by suitable driver motor 118. The fiber passes again through the oxidation zone and winds around passive roller 122 where it is pulled once again through the oxidation zone by second drive roller 126. The second or downstream drive roller 126 can be operated at a faster rotational speed or have a larger circumference than the initial or upstream drive roller 114 such that the fiber is stretched as it passes the second drive roller 126. This process can be repeated with other drive rollers to effect further stretching. The fiber passes through the oxidation zone again and winds about passive roller 130 and is then pulled back through the oxidation zone by third drive roller 134. The fiber exits the oxidation zone through exit roller 138 where it is directed to a subsequent stage of the process as shown by arrow 142. Air inlet 146 supplies oxygen for the oxidation process and a suitable heater 150 can be provided to heat the air to the appropriate temperature. Other oxidation zone constructions are possible. Due to the exothermic nature of the process of the invention, a reduction of up to 25% of the external energy required for the oxidation ovens in a conventional carbon fiber production line is possible. It will be appreciated that oxidation ovens of many types and sizes are known in the industry and are suitable for the invention.

EXAMPLE 1

A dual use acrylic fiber precursor copolymer (Textile 1) containing approx. 94.5 mole % acrylonitrile content and approx. 5.4 mole % methyl acrylate and 0.1 mole % 2-acrylamido-2-methylpropane sulfonic acid [approx., 91.3 weight % acrylonitrile and 8.7 weight % methyl acrylate and 2-acrylamido-2-methylpropane sulfonic acid]; 457,000 filaments in a tow, 2.0 denier per filament was converted to carbon fiber on a semi-production scale line. The line consisted of four oxidation zones, a low temperature furnace, a high temperature furnace, conventional electrolytic surface treatment, sizing and conveyance equipment. The heated length for each of the oxidation zones was between 7 and 8 meters. The fiber made a total of 22 passes through the four oxidation zones. The low temperature furnace had 4 temperature zones and the high temperature furnace had five temperature zones. Each furnace had 5 meters of heated length. The process chamber width was 12.5 inches. The carbon fiber tows comprised 5 separated bands having 457,000 filaments per band for a total of 4,570,000 denier across the width of the oxidation oven. This exceeded equipment design, which is equivalent to approximately 600,000 denier width concentration. The fiber concentration across the width of the roll entering the first oxidation oven was 4,570,000 denier or 381,000 denier per inch width.

The oxidized fiber density measured at each stage of oxidation along with other process parameters and resulting carbon fiber properties are shown in Table 3.

TABLE 3

| Oxidation Zone | Fiber Density (g/cc) |
|---|---|
| Zone 1 - 5 passes | 1.2150 |
| Zone 2 - 6 passes | 1.2716 |
| Zone 3 - 5 passes | 1.3013 |
| Zone 4 - 6 passes | 1.3519 |
| Precursor Properties | |
| Oxidation Load Concentration (denier/inch width) | 380,833 |
| PAN weight % | ~91.3 |
| Comonomer weight % (methyl acrylate) | ~8.4 |
| Monomer with non-carboxylic accelerant functional groups (weight %) | ~0.3 |
| Denier (g/9000 m) | 2.05 |
| Tenacity (g/den) | 4.11 |
| Elongation (%) | 32.38 |
| Finish Oil (%) | 0.48 |
| Number of Filaments per Tow Band | 457,152 |
| Resultant Carbon Fiber Properties | |
| Density (g/cc) | 1.77 |
| Tensile Modulus (Msi) | 39.2 |
| Tensile Strength (ksi) | 406.6 |
| Elongation (%) | 1.04 |
| Size Type | Epoxy |
| Filament Shape | Kidney Bean |
| Process Conditions | |
| Oxidation Temperatures 232° C.-242° C. | |
| Fiber speed at the entrance of oxidation zone 1: 0.38 m/min | |
| Oxidation Stretch | |
| Zone 1 (233° C.): 87% | |
| Zone 2 (232° C.): 63% | |
| Zone 3 (234° C.): 10% | |
| Zone 4 (242° C.): −2% | |
| Carbonization Stretch | |
| LT (565-665° C.): +4% | |
| HT (1450-1900° C.): −4% | |
| Carbonization Temperatures 565° C.-1900° C. | |

The high fiber loading and the cumulative heat from the oxidative exotherm in textile PAN allows the fiber to maintain higher temperatures even during multiple passes through passback rolls or drive rolls outside the oxidation zone (for example, oven) boundary. Retention of temperature in the thick precursor fiber band can effectively increase the heated length beyond the standard length of the oxidation zone or oven because of the oxidative exothermic heating that will continue outside of the oxidation zone. Fiber loading that is smaller than the invention can result in significant fiber cooling when the fiber leaves the oxidation zone or oven (see FIG. 4).

EXAMPLE 2

A second trial was performed with a second source of textile fiber [Textile 2: consisting of ~93.5 mole % AN and ~6.5 mole % vinyl acetate (equivalent to approx. 89.9 weight % AN and 10.1 weight % vinyl acetate)] for the initial evaluation. The fiber fusion temperature is significantly less than the case of the previous example mainly due to high vinyl acetate content. High vinyl acetate content also allows significant extensibility of the filaments due to a higher degree of interruption in PAN dipolar interaction. Therefore, during exothermic oxidation, at high fiber loading density, localized fusion was expected.

The dwell time and stretch limitations of the oxidation process equipment was exceeded in an attempt to oxidize the fiber. An unacceptable maximum fiber density of only 1.26 g/cc was achieved. As the fiber is stretched significantly (>100%) in first oxidation zone, residence time inside the oxidation zone gets significantly reduced, which results inadequate stabilization. The fiber density required before the fiber can be successfully carbonized is at least 1.33 g/cc. Two attempts were made to take this fiber through the low temperature furnace and both failed. There was no problem with an uncontrolled exothermic reaction in a high loading concentration, however longer oxidation dwell times (at low oxidation temperatures to avoid interfilament fusion) would be necessary for a successful result. A dwell time in excess of 10 hrs is believed to be necessary in this example for a successful result. It can be concluded from this that the presence or absence of accelerants combined with the degree of pre-orientation of the precursor (meaning significantly lower stretch in unoriented precursor and lower tension in conversion operations) are the two primary factors that cause traditional carbon fiber precursors to melt and to evolve heat that often results combustion of broken filaments when the fiber concentration exceeds a maximum loading level.

EXAMPLE 3

The same precursor discussed in Example 2 (Textile 2) when was prestretched at 190° C., 210° C., and 219° C. by single pass in three successive ovens followed by passes through 3 different oxidation zones with gradual increased temperatures up to 246° C., oxidized fibers produced at high inlet fiber loading condition (oxidation load at 276,666 denier/inch of tow width in the oven) exhibit density of 1.34 g/cc. Such fibers could then be successfully carbonized. The processing condition and properties of the resulting fibers are shown in Table 4.

TABLE 4

| Precursor Properties | |
|---|---|
| Oxidation Load Concentration (denier/inch width) | 276,666 |
| PAN weight % | ~89.9 |
| Comonomer weight % (vinyl acetate) | ~10.1 |
| Monomers with Accelerant Functional Groups (weight %) | 0 |
| Denier (g/9000 m) | 2.0 |
| Number of Filaments per Tow Band | 415,000 |
| **Resultant Carbon Fiber Properties** | |
| Density (g/cc) | 1.7042 |
| Tensile Modulus (Msi) | 25.13 |
| Tensile Strength (ksi) | 268.7 |
| Elongation (%) | 1.06 |
| Size Type | Epoxy |
| Filament Shape | Round |
| **Process Conditions** | |
| Oxidation Temperatures 190 C.-246 C. | |
| Fiber speed at the entrance of oxidation zone 1: 0.42 m/min | |
| Oxidation Stretch | |
| Zone 1 (190° C.): 72% | |
| Zone 2 (210° C.): 72% | |
| Zone 3 (219° C.): 37% | |
| Zone 4 (226° C.): 28% | |
| Zone 5 (235° C.): 4% | |
| Zone 6 (246° C.): 3% | |
| Carbonization Stretch | |
| LT (500-625° C.): 0% | |
| HT (1450-1700° C.): −6% | |
| Carbonization Temperatures 500 C.-1700 C. | |

EXAMPLE 4

A third trial was performed with precursor fiber with ~96.4 mole % AN content (~3.6 mole % methyl acrylate content). This precursor fiber was brittle due to the high PAN content and some porous structure in the as-received textile. It seemed difficult to process in the conversion line using this technique. High AN content causes higher heat of reaction and less extensibility due to less interrupted dipole-dipole interaction in PAN segment of precursor molecule in fibers. That limits high concentration loading at the inlet of oxidation. The process conditions and resultant carbon fiber properties are shown below in Table 5.

TABLE 5

| Oxidation Zone | Fiber Density (g/cc) |
|---|---|
| Zone 1 - 5 passes | 1.2130 |
| Zone 2 - 6 passes | 1.2240 |
| Zone 3 - 5 passes | 1.2794 |
| Zone 4 - 6 passes | 1.3611 |
| **Precursor Properties** | |
| Oxidation Load Concentration (denier/inch width) | N/A (high throughput conversion was not explored; only feasibility of using this textile to form adequate modulus CF was verified) |
| PAN weight % | ~94.3 |
| Comonomer weight % (methyl acrylate) | ~5.7 |
| Accelerant Functional Groups (weight %) | 0 |
| Denier (g/9000 m) | 2.0 |
| Number of Filaments per Tow Band | 57,000 |
| **Resultant Carbon Fiber Properties** | |
| Density (g/cc) | 1.754 |
| Tensile Modulus (Msi) | 30.7 |
| Tensile Strength (ksi) | 247.2 |
| Elongation (%) | 0.80 |
| Size Type | Epoxy |
| Filament Shape | Dog Bone |
| **Process Conditions** | |
| Oxidation Temperatures 228° C.-254° C. | |
| Oxidation Stretch | |
| Zone 1 (228 C.): 55% | |
| Zone 2 (232 C.): 25% | |
| Zone 3 (249 C.): 18% | |
| Zone 4 (260 C.): −2% | |
| Carbonization Stretch | |
| LT (550-650 C.): 2% | |
| HT (1450 C.): −6% | |
| Carbonization Temperatures 550° C.-1450° C. | |

EXAMPLE 5

Additional trials have been performed with Textile 1 (see example 1) at high concentration loading at the inlet to oxidation to demonstrate repeatability of the process and attempt to determine the optimal mechanical carbon fiber performance with this method. Example 5 represents one of these trials. The results showed that the process is stable and reliable. The conveyance equipment limitation, or drive capacities to pull the fiber, were met and exceeded with this level of loading in oxidation. This trial was a success, but higher loading of precursor tow band (>5) with the existing conveyance equipment seems unlikely due to its power limitations. The thermochemical reaction in oxidation seemed to have more capacity to expand the load concentration beyond this level. The process conditions and resultant carbon fiber properties are shown below in Table 6. Acrylic fiber precursor copolymer Textile 1 (same as in example 1) containing ~94.5 mol % acrylonitrile content was used in this study.

TABLE 6

| Oxidation Zone | Fiber Density (g/cc) |
|---|---|
| Zone 4 | 1.3457 |
| Precursor Properties | |
| Oxidation Load Concentration (denier/inch width) | 468,000 |
| PAN weight % | ~91.3 |
| Comonomer weight % (methyl acrylate) | ~8.4 |
| Monomer with non-carboxylic accelerant functional groups (weight %) | ~0.3 |
| Denier (g/9000 m) | 2.0 |
| Number of Filaments per Tow Band | 457,000 |
| Resultant Carbon Fiber Properties | |
| Density (g/cc) | 1.7889 |
| Tensile Modulus (Msi) | 40.72 |
| Tensile Strength (ksi) | 446.95 |
| Elongation (%) | 1.10 |
| Size Type | Epoxy |
| Filament Shape | Kidney Bean |
| Process Conditions | |
| Oxidation Temperatures 232° C.-250° C. | |
| Fiber speed at the entrance of oxidation zone 1: 0.38 m/min | |
| Oxidation Stretch | |
| Zone 1 (233° C.): 72% | |
| Zone 2 (232° C.): 55% | |
| Zone 3 (234° C.): 18% | |
| Zone 4 (242° C.): 0% | |
| Carbonization Stretch | |
| LT (565-665° C.): 3% | |
| HT (1470-1950° C.): −4% | |
| Carbonization Temperatures 565° C.-1950° C. | |

EXAMPLE 6

Another textile grade precursor that was processed contained ~94.3 mole % AN and 5.7 mole % vinyl acetate comonomer [equivalent to approx. ~91.1 weight % AN with remaining fraction (~8.9 weight %) vinyl acetate]. This fiber was, in fact, larger in tow size (750,000 filaments per tow). The precursor fiber had 1.6 denier linear density. The large tow was loaded in oxidation oven at high inlet loading (300,000 denier/inch width of oven) and oxidized in 4 oxidation zones from 219-252° C. Oxidized fibers of 1.39 g/cc density was successfully obtained and successfully carbonized to obtain carbonized fibers with acceptable properties (tensile strength >250 ksi and tensile modulus >25 Msi). The process parameters and properties are shown in Table 7.

TABLE 7

| Precursor Properties | |
|---|---|
| Oxidation Load Concentration (denier/inch width) | 300,000 |
| PAN weight % | ~91.1 |
| Comonomer weight % (vinyl acetate) | ~8.9 |
| Accelerant Functional Groups (weight %) | 0 |
| Denier (g/9000 m) | 1.6 |
| Number of Filaments per Tow Band | 750,000 |
| Resultant Carbon Fiber Properties | |
| Density (g/cc) | 1.68 |
| Tensile Modulus (Msi) | 26.0 |
| Tensile Strength (ksi) | 252.5 |

TABLE 7-continued

| | |
|---|---|
| Elongation (%) | 0.96 |
| Size Type | Epoxy |
| Filament Shape | Round |
| Process Conditions | |
| Oxidation Temperatures 219° C.-252° C. | |
| Fiber speed at the entrance of oxidation zone 1: 0.25 m/min | |
| Oxidation Stretch | |
| Zone 1 (219° C.): 77% | |
| Zone 2 (228° C.): 50% | |
| Zone 3 (239° C.): 11% | |
| Zone 4 (252° C.): 3% | |
| Carbonization Stretch | |
| LT (565-665° C.): −8% | |
| HT (1427-1600° C.): −4% | |
| Carbonization Temperatures 500 C.-1600 C. | |

EXAMPLE 7

Characteristics of Precursors with and without Accelerant Functionalities.

Figure 7A:
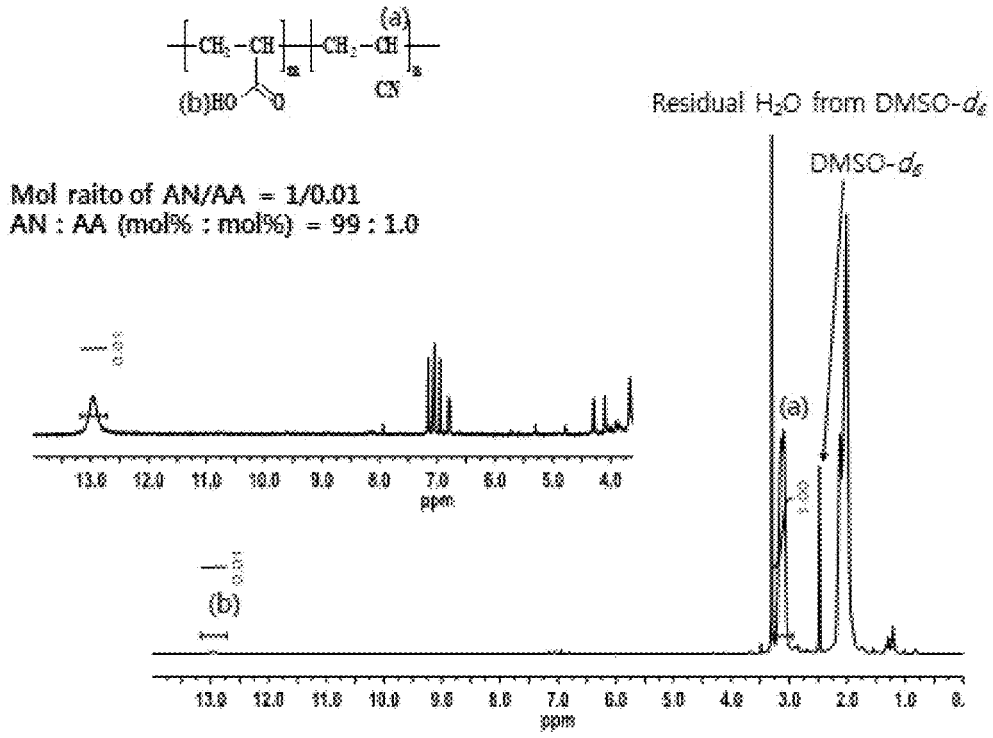
FIG. 7*a* is $^1$H-NMR spectrum of an accelerant (—COOH) containing specialty acrylic fibers (SAF 1) or specialty PAN precursor consisting of 99 mole % AN and 1 mole % acrylic acid (equivalent to 98.6 weight % AN and 1.4 weight acrylic acid).
Figure 7B:
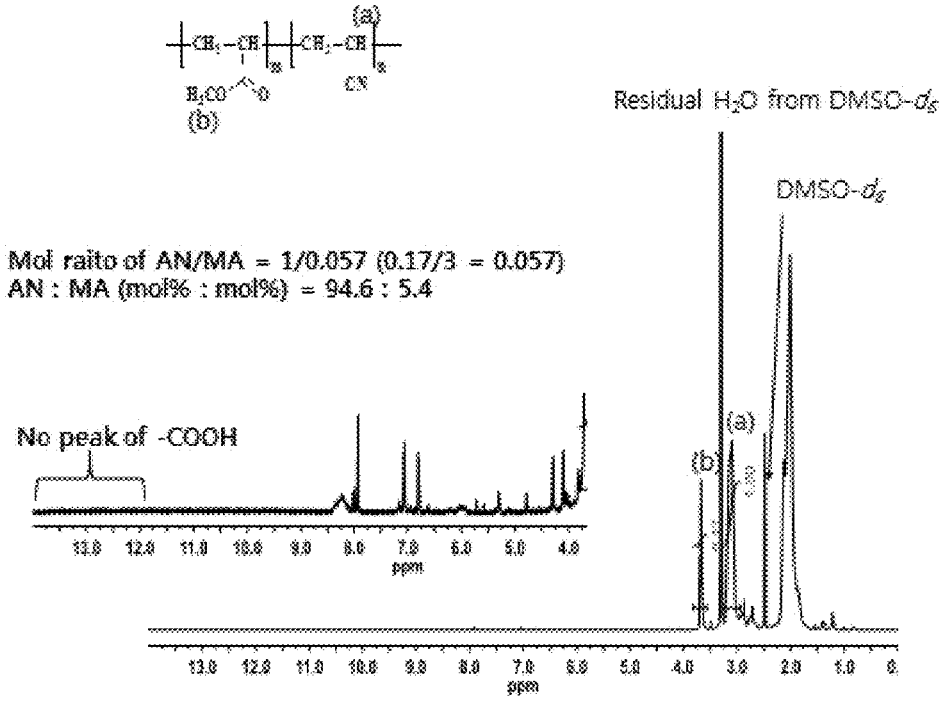
FIG. 7*b* is $^1$H-NMR spectrum of a non-carboxylic acid containing textile PAN precursor (Textile 1) consisting of approx. 94.5 mole % AN, ~5.4 mole % methyl acrylate, and ~0.1 mole % 2-acrylamido-2-methylpropane sulfonic acid.
Figure 7C:
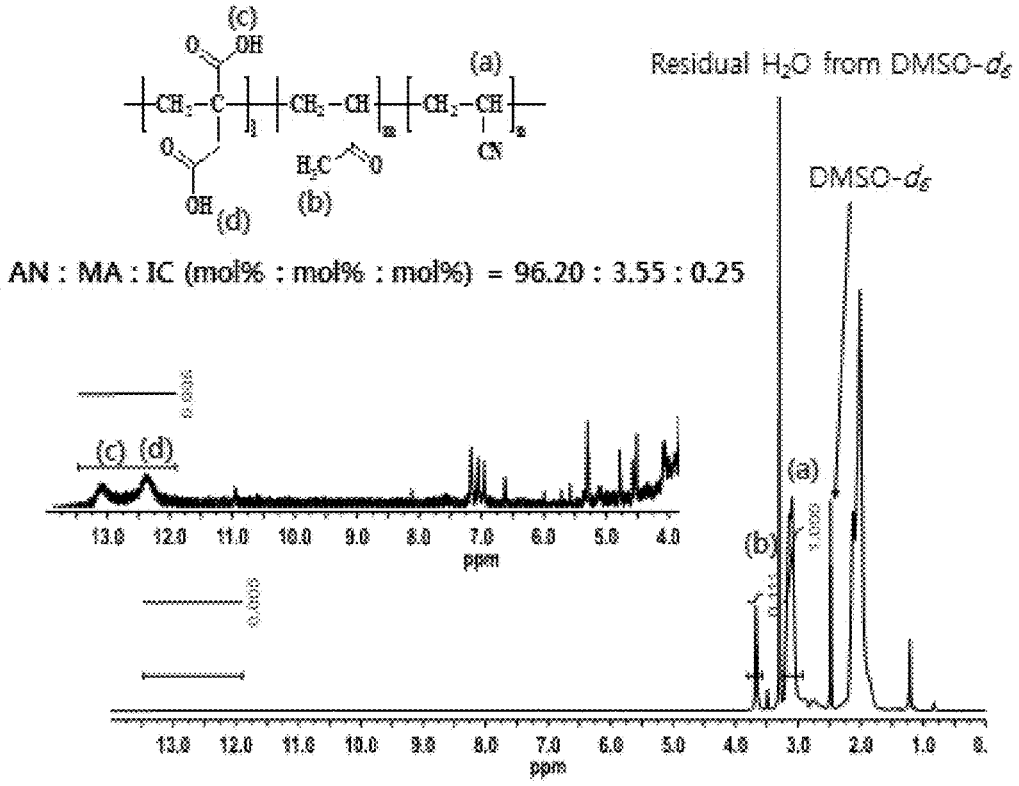
FIG. 7*c* is $^1$H-NMR spectrum of an accelerant (—COOH) containing specialty acrylic fibers (SAF 2) or specialty PAN precursor consisting of ~96.2 mole % AN, ~3.55 mole % methyl acrylate and ~0.25 mole % itaconic acid (equivalent to 93.8 weight % AN, 5.6 weight % methyl acrylate, and 0.6 weight itaconic acid).
Figure 7D:
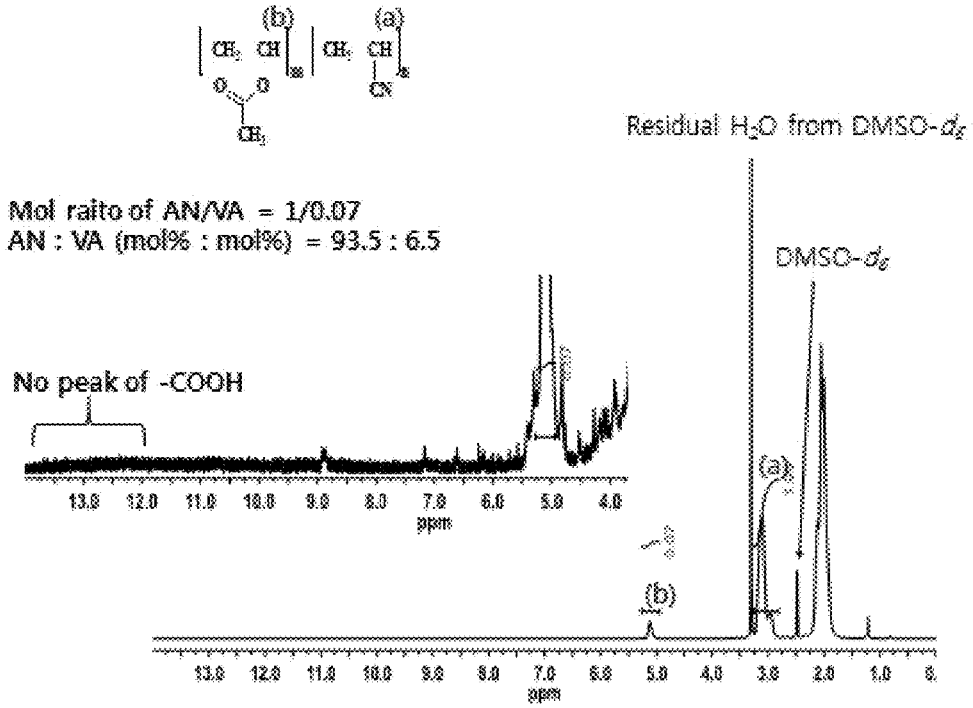
FIG. 7*d* is $^1$H-NMR spectrum of a non-accelerant containing textile PAN precursor (Textile 2) consisting of ~93.5 mole % AN and ~6.5 mole % vinyl acetate (equivalent to 89.9 weight % AN and 10.1 weight % vinyl acetate).

$^1$H-NMR spectrum of a specialty PAN precursor (SAF 1) with composition containing 1 mole % acrylic acid and 99 mole % AN [equivalent to 98.6 weight % AN and 1.4 weight % acrylic acid] is shown in FIG. 7*a*. This composition is an example of a specialty acrylic fiber containing accelerant functional group (—COOH) from acrylic acid comonomer that is visible in FIG. 7*a* at 13 ppm range of proton NMR spectrum. A $^1$H-NMR spectrum of a PAN precursor with composition containing approx. ~94.6 mole % AN and ~5.4 mole % methyl acrylate [equivalent to approx. 91.5 weight % AN and 8.5 weight % methyl acrylate] is shown in FIG. 7*b*. Absence of any discernible peak at 12-13 ppm in the spectra indicates lack of —COOH accelerant functionality. The polymer, however, shows fine structures around 8 ppm and 6 ppm suggesting very low concertation of acrylamide derivative. By further analysis presence of 0.1 mol % 2-acrylamido-2-methylpropane sulfonic acid in the polymer was confirmed. Thus, this composition suggests presence of 0.2 mole % of non-carboxylic acid accelerant functionality (both amide and sulfonic acid groups). A specialty PAN precursor consisting of ~96.2 mol % AN, ~3.55 mole % methyl acrylate, and ~0.25 mole % itaconic acid (SAF 2) are shown in FIG. 7*c*. Presence of 0.25 mole % itaconic acid indicates 0.5 mole % accelerant functionality (—COOH). FIG. 7*d* shows $^1$H-NMR spectrum of a textile PAN precursor with composition containing approx. ~93.5 mole % AN and ~6.5 mole % vinyl acetate (Textile 2). Among all these 4 samples only the samples that do not have —COOH group (shown in FIG. 7*b* and FIG. 7*d*; i.e., Textile 1 and Textile 2) could be successfully stabilized and carbonized at high concentration loading process (>150,000 denier per inch tow arrangement at oxidation zone 1 inlet). Precursor samples containing compositions shown in FIG. 7*a* and FIG. 7*c* (i.e., those containing significant —COOH accelerant functionalities) could not be fed through the oxidation zone at high concentration loading as it broke and underwent combustion due to extreme exothermic reaction condition.

Figure 8:
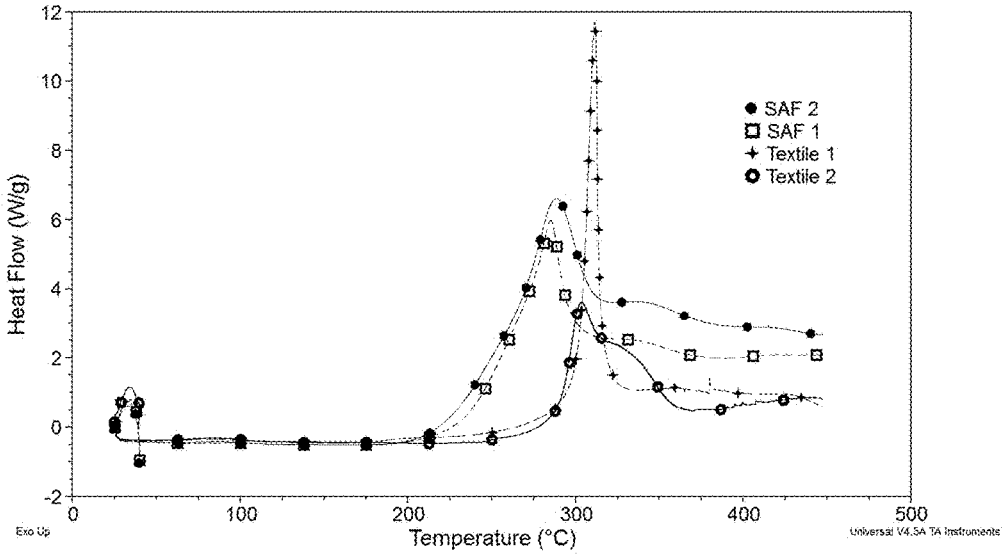
FIG. 8 is differential scanning calorimeter thermograms of accelerant containing specialty PAN precursors (SAF 1 and SAF 2) and non-accelerant containing textile PAN precursors (Textile 1 and Textile 2) showing difference is their onset temperatures associated with exothermic oxidation reaction in air (at 10° C./min scan rate).
Figure 9:
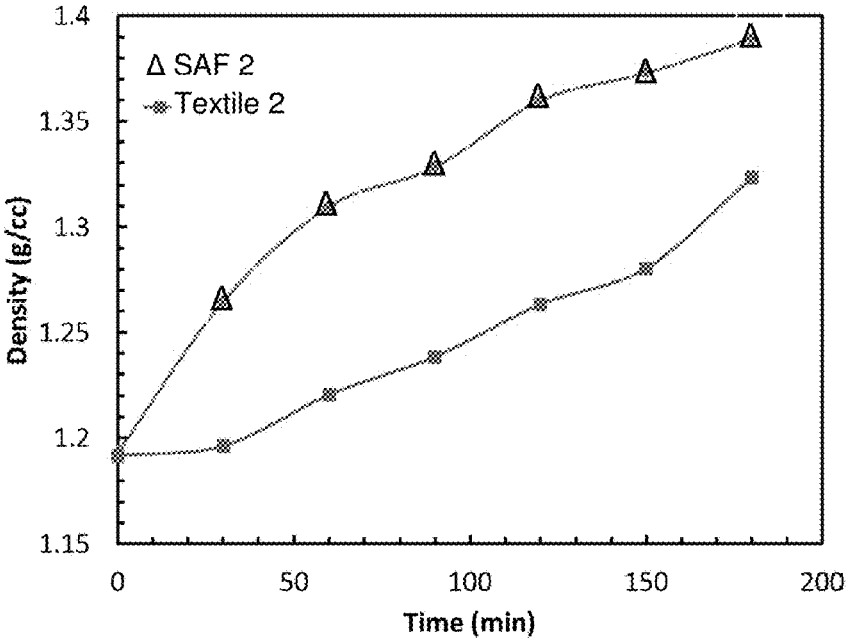
FIG. 9 is the time-dependent density evolution profiles of an accelerant functional group (—COOH) containing specialty PAN precursor sample and a non-accelerant containing textile PAN precursor when isothermally treated (simultaneously) in an oxidation zone in air at 220° C.

Differential scanning calorimeter thermograms of accelerant functionality (—COOH group) containing carbon fiber precursor (SAF 1 and SAF 2) and a textile fiber without significant accelerant groups (Textile 1 and Textile 2) are shown in FIG. 8. These thermograms were obtained at 10° C./min heating scan rate. The presence of —COOH group caused rapid exothermic heat evolution beyond 225° C. in the SAF samples. For the textile PAN exothermic reaction is not significant until 275° C. was reached. A slower oxidation kinetics in textile PAN fibers below 275° C. was confirmed from a density evolution curve from the fibers' prolonged isothermal and simultaneous exposure at 220° C. in an oxidation zone. The density profiles of the samples (SAF 1 and Textile 1) as function of isothermal residence time are shown in FIG. 9. This data confirms lack of significant accelerant-role in the textile PAN precursor. The lack of abrupt exothermic reaction of textile PAN fibers at 220-250° C. allows those to be loaded at highly packed condition in an oxidation zone compared to the specialty acrylic fibers that contains accelerant functional groups and undergoes autoignition and combustion under high loading conditions.

Figure 10:
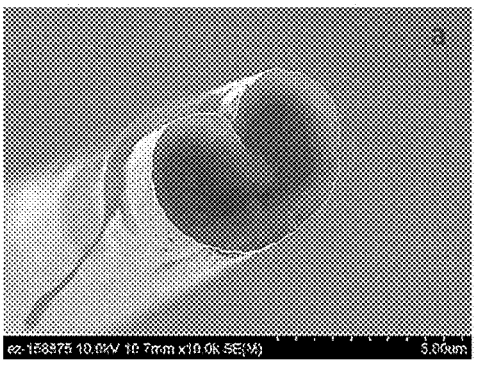
FIG. 10 is the scanning electron micrograph of a textile PAN-based carbon fiber.
Figure 11:
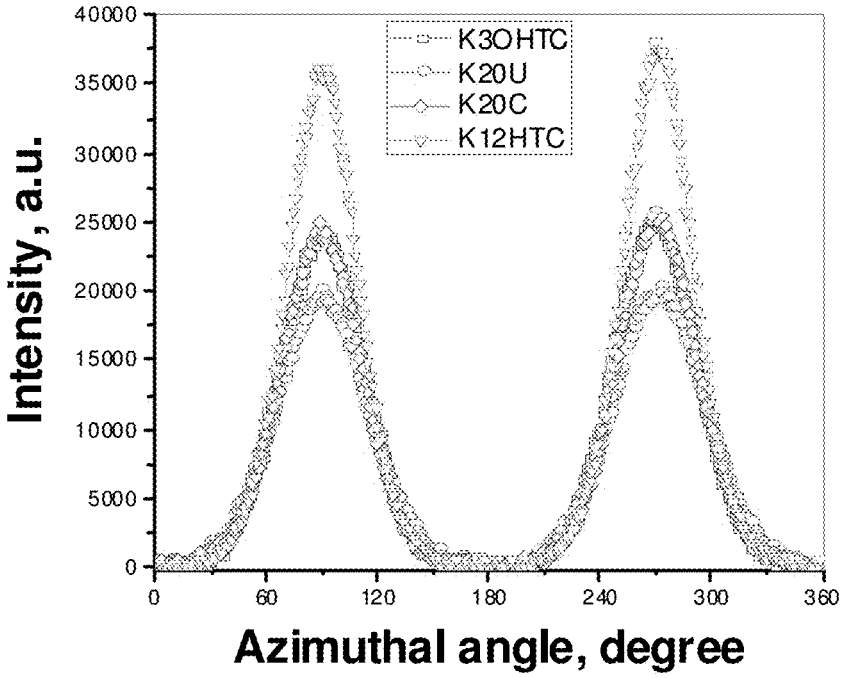
FIG. 11 is azimuthal profiles of (002) reflection intensities of different carbon fibers made from Textile 1 precursors as function of azimuthal angles (φ).

Textile PAN derived carbon fibers produced at 1400° C. (with density 1.77 g/cc, 3.08 GPa tensile strength and 228 GPa tensile modulus) exhibits bean shaped cross sections as shown by scanning electron micrograph in FIG. 10. When the same precursor fibers processed at different stretching and carbonization conditions, fibers with different properties were obtained (2.5-3.1 GPa tensile strength and 200-280 GPa tensile modulus). The X-ray diffraction pattern of the fiber can be used to determine the characteristics of the carbon fibers including their graphitic planes' orientation factors. Azimuthal breadth (in degrees) from the diffraction patterns of these carbon fiber sample, measured as full width at half maxima of the azimuthal distribution curve of (002) graphite reflection peaks, are significantly larger (45-68° depending on the degree of orientation obtained during stretching of the relatively less oriented textile precursor fibers) than those obtained from specialty PAN precursors (10-35°). Representative azimuthal profiles of different carbon fibers obtained from Textile 1 fibers are shown in FIG. 11. The sample ID used in FIG. 11 and their corresponding characteristics are summarized in Table 8.

TABLE 8

| Sample ID | K30HTC | K20U | K20C | K12HTC |
|---|---|---|---|---|
| Herman's orientation factor, S | 0.61 | 0.55 | 0.61 | 0.68 |
| $L_{c\text{-}axis}$, nm | 1.82 | 1.89 | 1.83 | 2.19 |
| Density, g/cc | 1.76 | 1.73 | 1.77 | 1.77 |
| Tensile strength (MPa) | 2565 | 2000 | 3082 | 2998 |
| Tensile modulus (GPa) | 207 | 170 | 228 | 276 |

Azimuthal profiles of (002) reflection intensities [I(φ)] of different carbon fibers made from Textile 1 precursors as function of azimuthal angles (φ) were used to measure the average square of the cosine of φ i.e., $\langle\cos^2\varphi\rangle$ where, $$\langle\cos^2\varphi\rangle = \frac{\int_0^{2\pi} I(\varphi)\cos^2\varphi\sin\varphi d\varphi}{\int_0^{2\pi} I(\varphi)\sin\varphi d\varphi}$$

This value was used to measure the graphite crystalline orientation factor expressed as Hermans' orientation factor, S;

where, $$S = \frac{3\langle\cos^2\varphi\rangle - 1}{2}$$

Accordingly, if all graphite planes are perfectly oriented along fiber axis direction, S=1. For random orientation of the graphitic planes S=0. A prior study revealed that the carbon fibers usually possess Hermans' orientation factor in the range of 0.76-0.99 (Anderson, David P. Carbon Fiber Morphology. 2. Expanded Wide-Angle X-Ray Diffraction Studies of Carbon Fibers. DAYTON UNIV. OH RESEARCH INST., 1991, incorporated by reference herein). This indicates that the graphene planes in conventional carbon fibers are mostly oriented along the fiber axis direction.

Although graphite crystal sizes (Lc) in the carbon fibers obtained from Textile 1 precursors are more or less similar to those of the standard PAN-based carbon fibers (1.8-2.2 nm), the resulting carbon fibers exhibits very low degree of orientation [Hermans' orientation factors <0.7]. The Hermans' orientation factors for the carbon fibers (from Textile 1) shown in FIG. 11 have S values: 0.55, 0.61, 0.61, and 0.68. Perfectly aligned crystals of carbon could offer a maximum possible value of Herman's orientation factor, 1. Such high orientation value can be achieved with graphite single crystals. Pitch-based carbon fiber may approach to such high orientation factor. Textile precursors being mostly unoriented plastic fiber (draw ratio 3-5×), although stretched during oxidative crosslinking and stabilization, those produce carbon fibers with signature of low orientation in graphite crystals. Nevertheless, orientation of these textile fibers (and thus the properties of the derived carbon fibers) can be improved significantly by deploying preoxidative stretching and maintaining high orientation and stretching during oxidation and carbonization steps. However, achieving as high an orientation factor as carbon fibers made from specialty acrylic fibers (SAF-PANs) may not be possible.

The invention is capable of producing new carbon fiber products. Such products have a Herman orientation factor (S) of between 0.55 and 0.80. The S of these carbon fiber products can be 0.55, 0.56, 0.57, 0.58, 0.59, 0.60, 0.61, 0.62, 0.63, 0.64, 0.65, 0.66, 0.67, 0.68, 0.69, 0.70, 0.71, 0.72, 0.73, 0.74, 0.75, 0.76, 0.77, 0.78, 0.79 or 0.80, or within a range of any high and low value selected from these values. The carbon fiber product can have a tensile modulus of between 25 and 40 Msi. The carbon fiber product can have a tensile modulus of 25, 26, 27, 28, 29, 30, 31, 32, 33, 34, 35, 36, 37, 38, 39, or 40, or within a range of any high and low value selected from these values. The carbon fiber product can have a tensile strain of at least 1%.

EXAMPLE 8

Validation of 2-fold Increase in Nameplate Production Capacity Using this Method of Conversion of Textile PAN Precursors.

The oxidation oven and carbonization furnace discussed in FIGS. 2, 3, and 4 is actually designed for operation of standard spooled 24 k or 48 k tow carbon precursor fibers. In a 12-inch oven width about 24 ends of 24 k tow precursor bands of SAF 2 can be fed through. The standard run condition and the properties of the resulting carbon fibers are given in Table 9.

TABLE 9

| Oxidation Zone | Fiber Density (g/cc) |
|---|---|
| Zone 4 | 1.3453 |

TABLE 9-continued

| Precursor Properties | |
|---|---|
| Oxidation Load Concentration (denier/inch width) | 62,400 |
| PAN weight % | ~93.8 |
| Comonomer weight % (methyl acrylate) | ~5.6 |
| Accelerant Functional Group containing monomer (itaconic acid) (weight %) | ~0.6 |
| Denier (g/9000 m) | 1.3 |
| Number of Filaments per Tow Band | 24,000 |
| Resultant Carbon Fiber Properties | |
| Density (g/cc) | 1.706 |
| Tensile Modulus (Msi) | 37.8 |
| Tensile Strength (ksi) | 560.3 |
| Elongation (%) | 1.48 |
| Size Type | Epoxy |
| Filament Shape | circular |
| Process Conditions | |
| Oxidation Temperatures 226° C.-254° C. | |
| Fiber speed at the entrance of oxidation zone 1: 1.70 m/min | |
| Oxidation Stretch | |
| Zone 1 (226° C.): 19% | |
| Zone 2 (229° C.): −2% | |
| Zone 3 (242° C.): −4% | |
| Zone 4 (254° C.): 4% | |
| Carbonization Stretch | |
| LT (565-665° C.): +4% | |
| HT (1433-1800° C.): −5% | |
| Carbonization Temperatures 550° C.-1800° C. | |

Based on above mass throughput in the oxidation oven 1=1.7 m/mim*24 tow*24000 filament/tow*1.3 (g/9000 m)/filament=141 g/mim=8.486 kg/h of precursor. Assuming 48% yield above throughput is equivalent to 4.073 kg/h carbon fiber production. This is the nameplate capacity of this pilot line. Encouraged by the results shown in Example 1, attempts were made to load 3 tow bands of 533,000 filament tow of Textile 1 precursor and the large tow combinations at high concentrations through the same oxidation oven over 6-inch width of the oven. The operation parameters and properties of the fibers are shown in Table 10.

TABLE 10

| Oxidation Zone | Fiber Density (g/cc) |
|---|---|
| Zone 4 | 1.33 |
| Precursor Properties | |
| Oxidation Load Concentration (denier/inch width) | 533,000 |
| PAN weight % | ~91.3 |
| Comonomer weight % (methyl acrylate) | ~8.4 |
| Monomer with non-carboxylic accelerant functional groups (weight %) | ~0.3 |
| Denier (g/9000 m) | 2.0 |
| Number of Filaments per Tow Band | 533,000 |
| Resultant Carbon Fiber Properties | |
| Density (g/cc) | 1.8329 |
| Tensile Modulus (Msi) | 30.0 |
| Tensile Strength (ksi) | 362 |
| Elongation (%) | 1.24 |
| Size Type | Epoxy |
| Filament Shape | Kidney bean |
| Process Conditions | |
| Oxidation Temperatures 231° C.-234° C. | |
| Fiber speed at the entrance of oxidation zone 1: 0.40 m/min | |

TABLE 10-continued

| Oxidation Stretch |
|---|
| Zone 1 (231° C.): 85% cumulative stretch |
| Zone 2 (229° C.): 45% cumulative stretch |
| Zone 3 (230° C.): 11% cumulative stretch |
| Zone 4 (232° C.): −2.5% cumulative stretch |
| Carbonization Stretch |
| LT (565-665° C.): +2% |
| HT (1365-1400° C.): −4% |
| Carbonization Temperatures 550° C.-1400° C. |

It may be noted that at very high concentration of fiber in the oxidation zone of 533,000 denier per inch width to maintain steady state without filament breakage the temperatures in oxidation zones were reduced. In this case exothermic energy evolved by slow oxidation reaction was significant to continue the oxidation reaction without raising the temperature of the oxidation zone significantly. Although the stabilized and LT carbonized fibers were heat treated up to 1400° C., those demonstrated moderate performance (360 ksi strength and 30 Msi modulus) and the modulus will likely increase with increase in carbonization temperature further.

Based on above mass throughput (at 3 bands of 533 k tow/6-inch width=6 bands of 533 k tow/12-inch width) in the oxidation zone 1=0.4 m/mim*6 tow*533, 000 filament/tow*2.0 (g/9000 m)/filament=284 g/mim=17.056 kg/h of precursor. Assuming 48% yield, the above throughput is equivalent to 8.186 kg/h carbon production. This is approximately double of the nameplate capacity of the pilot line used for this study.

It has been experimentally observed that these textiles when prestretched to form reduced denier it can go through the oxidation zone at higher speed than that of the unstretched precursor that requires to stretch inside the oxidation zone. Under that condition it exhibits further enhanced throughput.

The methods and techniques of the invention can result in expansion of up to 3 times or more the nameplate capacity of traditional carbon fiber conversion process equipment. Additionally, the power reduction per unit carbon fiber produced for the process of the invention can be up to 80% less than traditional carbon fiber conversion techniques due to the thermochemical reaction initiated in oxidative stabilization. Tow bundle sizes larger than traditional 3 k, 6 k, 12 k, 24 k and 50K filaments can improve the efficiency of intermediate and composite material manufacturing. Examples are carbon fiber prepreg, non-crimped carbon fiber fabric, chopped fiber and stitch bonded preform manufacturing. The commodity fiber conversion capability allows for optimal flexibility and efficiency in downstream composite processes due to larger tow bundle options.

Ranges: throughout this disclosure, various aspects of the invention can be presented in a range format. It should be understood that the description in the range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range for example, 1, 2, 2.7, 3, 4, 5, 5.3 and 6. This applies regardless of the breadth of the range.

This invention can be embodied in other forms without departing from the spirit or essential attributes thereof, and accordingly, reference should be had to the following claims to determine the scope of the invention.

We claim:

1. A method of producing carbon fibers, comprising the steps of:

providing polyacrylonitrile precursor polymer fibers, the polyacrylonitrile precursor filaments comprising from 87-97 mole % acrylonitrile, and comprising less than 0.5 mole % of accelerant functional groups, the filaments being no more than 3 deniers per filament;

arranging the polyacrylonitrile precursor filaments into tows of at least 150,000 deniers per inch width;

stabilizing the arranged polyacrylonitrile precursor fiber tows by heating the tows in at least one oxidation zone containing oxygen gas and maintained at a first temperature while stretching at least 10% to yield a stabilized precursor fiber; and, carbonizing the stabilized precursor fiber to produce carbon fiber.

2. The method of claim 1, wherein the carbon fiber has a tensile modulus of at least 30 Msi.

3. The method of claim 1, wherein the carbon fiber has a tensile strain of at least 1%.

4. The method of claim 1, wherein the accelerant functional group is an acid functional group that can initiate cyclization reaction in the polyacrylinitrile segment of the precursor polymer.

5. The method of claim 1, wherein the accelerant functional group is at least one selected from the group consisting of an amino group (—NH2), a substituted amino group (—NH—), an amide group (—CO—NH—), a carboxylic acid group (COOH) and a sulfonic acid group (—SO3H), and salts of all accelerant groups that can initiate cyclization reaction in the polyacrylinitrile segment of the precursor polymer.

6. The method of claim 1, wherein the accelerant functional group is an electron donating functional group that can initiate cyclization reaction in the polyacrylinitrile segment of the precursor polymer.

7. The method of claim 1, wherein the polyacrylonitrile precursor polymer filaments comprise from 91-94 mole % acrylonitrile.

8. The method of claim 1, wherein the polyacrylonitrile precursor polymer filaments comprise at least 87 mole % acrylonitrile.

9. The method of claim 1, wherein the polyacrylonitrile precursor polymer filaments comprise at least 88 mole % acrylonitrile.

10. The method of claim 1, wherein the polyacrylonitrile precursor polymer filaments comprise at least 89 mole % acrylonitrile.

11. The method of claim 1, wherein the polyacrylonitrile precursor polymer filaments comprise at least 90 mole % acrylonitrile.

12. The method of claim 1, wherein the polyacrylonitrile precursor polymer filaments comprise at least 91 mole % acrylonitrile.

13. The method of claim 1, wherein the polyacrylonitrile precursor filaments comprise at least 92 mole % acrylonitrile.

14. The method of claim 1, wherein the polyacrylonitrile precursor polymer filaments comprise at least 93 mole % acrylonitrile.

15. The method of claim 1, wherein the polyacrylonitrile precursor polymer filaments comprise at least 94 mole % acrylonitrile.

16. The method of claim 1, wherein the polyacrylonitrile precursor polymer filaments comprise at least 95 mole % acrylonitrile.

17. The method of claim 1, wherein the polyacrylonitrile precursor polymer filaments comprise at least 96 mole % acrylonitrile.

18. The method of claim 1, wherein the polyacrylonitrile precursor polymer filaments comprise no more than 97 mole % acrylonitrile.

19. The method of claim 1, wherein the polyacrylonitrile precursor polymer filaments comprise no more than 96 mole % acrylonitrile.

20. The method of claim 1, wherein the polyacrylonitrile precursor polymer filaments comprise no more than 95 mole % acrylonitrile.

21. The method of claim 1, wherein the polyacrylonitrile precursor polymer filaments comprise no more than 94 mole % acrylonitrile.

22. The method of claim 1, wherein the polyacrylonitrile precursor polymer filaments comprise no more than 93 mole % acrylonitrile.

23. The method of claim 1, wherein the polyacrylonitrile precursor polymer filaments comprise no more than 92 mole % acrylonitrile.

24. The method of claim 1, wherein the polyacrylonitrile precursor polymer filaments comprise no more than 91 mole % acrylonitrile.

25. The method of claim 1, wherein the polyacrylonitrile precursor polymer filaments comprise no more than 90 mole % acrylonitrile.

26. The method of claim 1, wherein the polyacrylonitrile precursor polymer filaments comprise no more than 89 mole % acrylonitrile.

27. The method of claim 1, wherein the polyacrylonitrile precursor polymer filaments comprise no more than 88 mole % acrylonitrile.

28. The method of claim 1, wherein the arranged precursor fiber tows are between 150,000 deniers per inch width and 3,000,000 deniers per inch width.

29. The method of claim 1, wherein the arranged precursor fiber tows are between 250,000 deniers per inch width and 3,000,000 deniers per inch width.

30. The method of claim 1, wherein the arranged precursor fiber tows are between 500,000 deniers per inch width and 3,000,000 deniers per inch width.

31. The method of claim 1, wherein the polyacrylonitrile precursor polymer filaments comprise a comonomer that is polymerized with the acrylonitrile monomer.

32. The method of claim 31, wherein the comonomer is at least one selected from the group consisting of methyl acrylate and vinyl acetate.

33. The method of claim 1, wherein filaments are arranged into fiber tows comprising between 3000 and 3,000,000 filaments.

34. The method of claim 1, wherein the filament count is between 100,000 and 3,000,000 filaments per inch width.

35. The method of claim 1, further comprising a stretching step prior to the oxidizing step, the stretching step reducing the filament diameter.

36. The method of claim 1, wherein the carbonization step comprises passing the stabilized precursor fiber tows through at least two carbonization zones.

37. The method of claim 36, wherein the first carbonization zone is maintained at a temperature between 500-1000° C. and the second carbonization zone is maintained between 1000-2000° C.

38. The method of claim 1, further comprising the step of heating the tows in a second oxidation zone containing oxygen gas and maintained at a temperature T2, wherein T2 is less than a first temperature T1 of the first oxidation zone.

39. The method of claim 1, further comprising a sizing step after the carbonization step.

40. The method of claim 1, further comprising a surface treatment step after the carbonization step.

41. The method of claim 1, wherein the polyacrylonitrile precursor polymer fibers are stretched between 100-600% during the oxidation process.

42. The method of claim 1, wherein the throughput rate of precursor filament is at least 900 deniers per inch width of oxidation zone, per minute.

43. The method of claim 1, wherein the throughput rate of precursor filament is at least 1200 deniers per inch width of oxidation zone, per minute.

44. The method of claim 1, wherein the throughput rate of precursor filament is from at least 2,000 to 5,000 deniers per inch width of oxidation zone, per minute.

45. A method of producing carbon fibers, comprising the steps of:

providing polyacrylonitrile precursor polymer fiber filaments, the polyacrylonitrile precursor polymer fiber filaments comprising from 87-97 mole % acrylonitrile and comprising less than 0.5 mole % of accelerant functional groups, the filaments being no more than 3 deniers per filament;

arranging the polyacrylonitrile precursor fiber filaments into at least 150,000 deniers per inch width; and, stabilizing the arranged polyacrylonitrile precursor fiber by heating the arranged fiber filaments in at least one oxidation zone containing oxygen gas and maintained at a first temperature while stretching the tows at least 10% to yield a stabilized precursor fiber.

46. The method of claim 45, wherein the stabilized fibers are flame retardant.

47. A method of producing flame retardant fibers, comprising the steps of:

providing polyacrylonitrile precursor polymer fibers, the polyacrylonitrile precursor filaments comprising from 87-97 mole % acrylonitrile, and comprising less than 0.5 mole % of accelerant functional groups, the filaments being no more than 3 deniers per filament;

arranging the polyacrylonitrile precursor filaments into tows of at least 150,000 deniers per inch width; and stabilizing the arranged polyacrylonitrile precursor fiber tows by heating the tows in at least one oxidation zone containing oxygen gas and maintained at a first temperature while stretching at least 10% to yield a stabilized precursor fiber.

48. A method of producing stabilized fibers, comprising the steps of:

providing polyacrylonitrile precursor polymer fibers, the polyacrylonitrile precursor filaments comprising from 87-97 mole % acrylonitrile, and comprising less than 0.5 mole % of accelerant functional groups, the filaments being no more than 3 deniers per filament;

arranging the polyacrylonitrile precursor filaments into tows of at least 150,000 deniers per inch width; and stabilizing the arranged polyacrylonitrile precursor fiber tows by heating the tows in at least one oxidation zone containing oxygen gas and maintained at a first temperature while stretching at least 10% to yield a stabilized precursor fiber.

49. The method of claim 1, wherein the carbon fiber has a Herman orientation factor (S) of graphitic planes between 0.55-0.80, a tensile modulus of from 30 to 40 Msi, and a tensile strain of at least 1%.

50. The method of claim 1, wherein the carbon fiber has a Herman orientation factor (S) of graphitic planes between 0.55-0.70, a tensile modulus of from 30 to 40 Msi, and a tensile strain of at least 1%.

* * * * *